US007506626B2

(12) United States Patent
Sasaki et al.

(10) Patent No.: US 7,506,626 B2
(45) Date of Patent: Mar. 24, 2009

(54) DEVICE AND METHOD FOR AMPLIFYING SUCTION NOISE

(75) Inventors: Akira Sasaki, Zushi (JP); Hiroyuki Abe, Kawasaki (JP); Shunsuke Ebata, Zama (JP); Hiromichi Akamatsu, Machida (JP); Hiroshi Miyauchi, Hadano (JP)

(73) Assignee: Nissan Motor Co., Ltd., Yokohama, Kanagawa (JP)

( * ) Notice: Subject to any disclaimer, the term of this patent is extended or adjusted under 35 U.S.C. 154(b) by 30 days.

(21) Appl. No.: 11/810,095

(22) Filed: Jun. 4, 2007

(65) Prior Publication Data

US 2007/0292281 A1 Dec. 20, 2007

(30) Foreign Application Priority Data

Jun. 5, 2006 (JP) ..... 2006-155944
Jun. 13, 2006 (JP) ..... 2006-163801

(51) Int. Cl.
*F02M 35/10* (2006.01)

(52) U.S. Cl. ..... 123/184.53; 181/229; 181/160

(58) Field of Classification Search ..... 123/184.53, 123/184.57; 181/160, 229
See application file for complete search history.

(56) References Cited

U.S. PATENT DOCUMENTS

2004/0011011 A1 1/2004 Storz et al.

FOREIGN PATENT DOCUMENTS

| | | | |
|---|---|---|---|
| DE | 44 35 296 | A1 | 10/1994 |
| DE | 101 61 874 | A1 | 12/2001 |
| EP | 1 350 945 | A2 | 10/2003 |
| EP | 1736349 | A1 * | 12/2006 |
| JP | 2000045895 | | 2/2000 |
| JP | 3613665 | | 10/2000 |
| JP | 2004-293365 | | 10/2004 |
| JP | 2005139982 | | 6/2005 |

* cited by examiner

*Primary Examiner*—Noah Kamen
(74) *Attorney, Agent, or Firm*—Young Basile

(57) ABSTRACT

An amplification device for amplifying suction noise of a vehicle is disclosed herein. An embodiment of the amplification device comprises an intake duct, a connecting pipe, an elastic membrane member and a contact member. The intake duct feeds air into an engine inlet port. A connecting pipe is connected to an interior of the intake duct. The elastic membrane member blocks a passageway inside of the contacting pipe. The contact member is connected to the connecting pipe and includes at least one portion that is adapted to selectively contact a surface of the elastic membrane member that faces the intake duct.

22 Claims, 16 Drawing Sheets

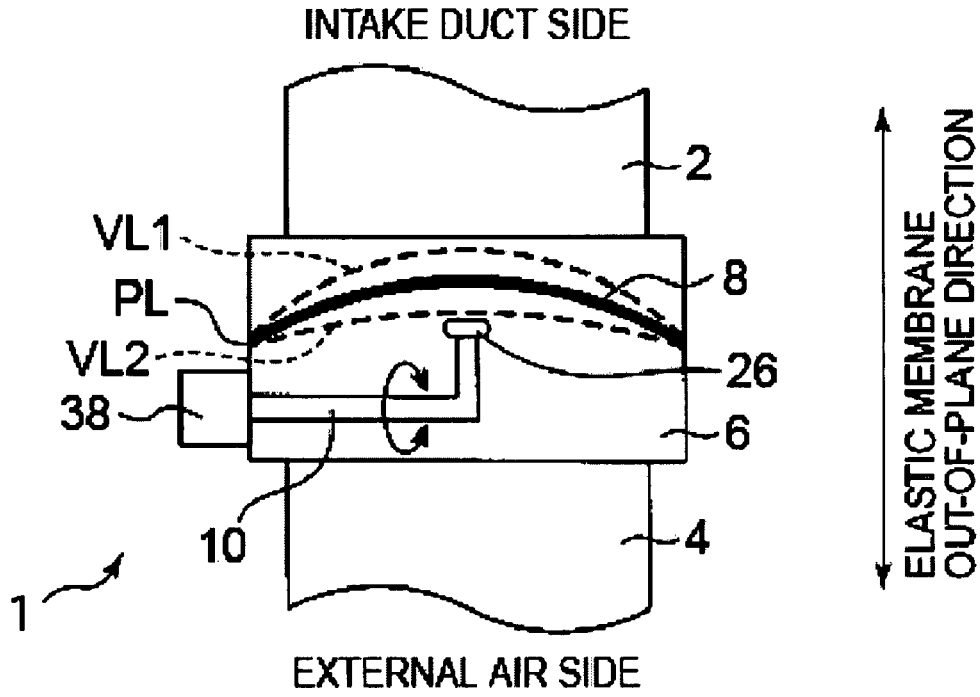
FIG. 13
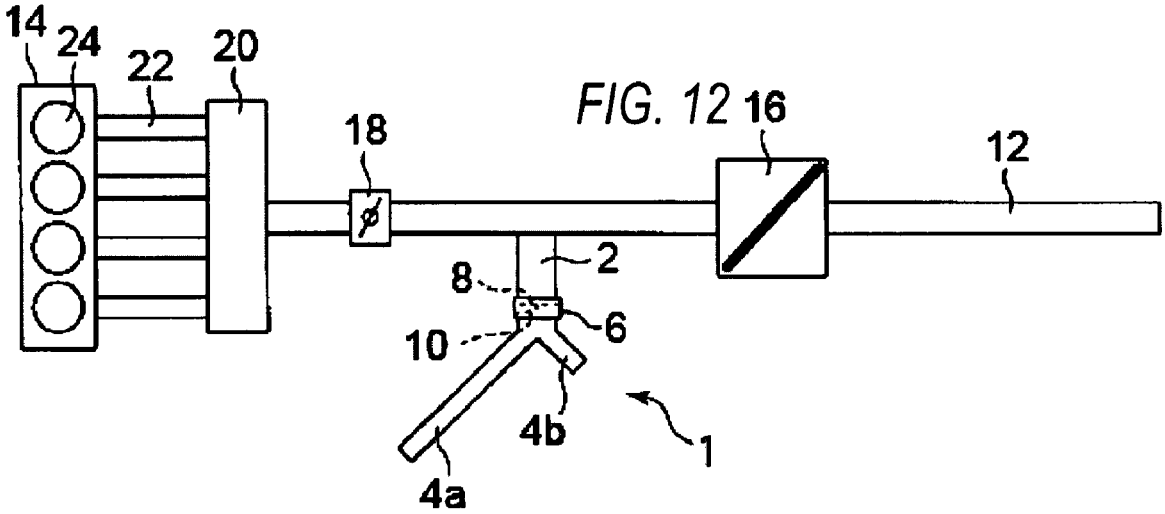
FIG. 12
FIG. 14

DEVICE AND METHOD FOR AMPLIFYING SUCTION NOISE

CROSS-REFERENCE TO RELATED APPLICATIONS

This application claims priority from Japanese Patent Application Serial Nos. 2006-155944 filed Jun. 5, 2006 and 2006-163801 filed Jun. 13, 2006, the disclosures of which, including their specification, drawings and claims, are incorporated herein by reference in their entirety.

TECHNICAL FIELD

The present disclosure pertains to a device and method for improving the sound quality of the suction noise generated by the intake system of automobiles, etc.

BACKGROUND

Related art devices that amplify suction noise include, for example, the devices described in Japanese Patent Application No. 2004-218458 and Japanese Patent Application No. 2005-139982. In the amplification device described in Japanese Patent Application No. 2004-218458, an intake duct is connected to a dashboard by a flexible tube so that suction noise may be fed into a vehicle cabin. The amplification device of a vehicle described in 2005-139982 has a connecting pipe connected to an interior of the intake duct and an elastic membrane that blocks the connecting pipe. The elastic membrane is made to vibrate; corresponding to the variation in pressure generated inside the intake duct, thereby generating a sound that amplifies the suction noise.

However, above-described amplification devices are associated with certain problems. For instance, as the suction noise is amplified corresponding to variation in pressure in the intake duct, there is no way to selectively silence or minimize the suction noise. Thus, it would be desirable to reduce the effect of amplifying the suction noise.

SUMMARY

To selectively reduce the effect of amplification of suction noise, the present disclosure provides a method and an amplification device for amplifying suction noise. In one embodiment of the method an elastic membrane is made to vibrate due to a variation in pressure of air that is fed into an engine inlet port. Then, the vibration of the vibration membrane is selectively suppressed on the basis of an acceleration state of the vehicle, thereby reducing the effect of amplifying the suction noise on the basis of the acceleration state of the vehicle.

An amplification device for amplifying suction noise of a vehicle is also disclosed herein. An embodiment of the amplification device comprises an intake duct, a connecting pipe, an elastic membrane member and a contact member. The intake duct feeds air into an engine inlet port. A connecting pipe is connected to an interior of the intake duct. The elastic membrane member blocks a passageway inside of the contacting pipe. The contact member is connected to the connecting pipe and includes at least one portion that is adapted to selectively contact a surface of the elastic membrane member that faces the intake duct.

BRIEF DESCRIPTION OF DRAWINGS

Other features and advantages of the present disclosure will be apparent from the ensuing description, taken in conjunction with the accompanying drawings, in which:

FIG. 13 is a diagram illustrating the structure of a seventh embodiment of a connecting pipe connector for an amplification device.

FIG. 14 is a diagram illustrating the structure of an eighth embodiment of the amplification device.

DETAILED DESCRIPTION

Figure 1:
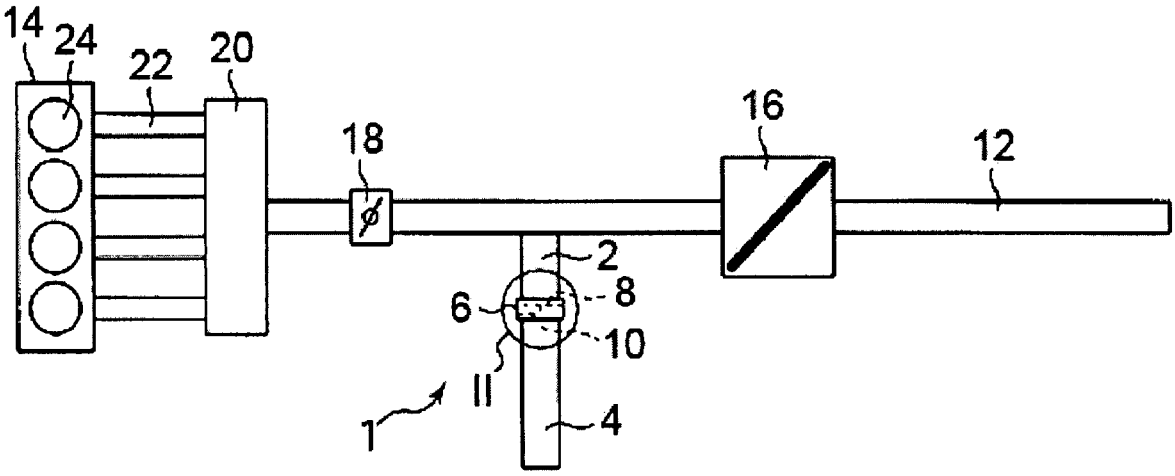
FIG. 1 is a diagram illustrating the structure of a first embodiment of an amplification device.

While the claims are not limited to the illustrated embodiments, an appreciation of various aspects of the apparatus is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

Embodiment 1

FIG. 1 is a diagram illustrating the structure of an amplification device 1 for amplifying suction noise according to a first embodiment. As shown in FIG. 1, amplification device 1 includes a connecting pipe 2, an additional pipe 4, a connecting pipe connector 6, an elastic membrane member 8, and a contact member 10.

Connecting pipe 2 is generally cylindrical in shape and is attached to an outer peripheral surface of an intake duct 12. Connecting pipe 2 is formed from a draft tube that contains air, and is connected to intake duct 12. Connecting pipe 2 is formed with an appropriate shape such that a resonance frequency of the air through a structure comprised of connecting pipe 2 and elastic membrane member 8 (hereinafter referred to as the first resonance frequency) corresponds to a first frequency selected from a plurality of frequencies of an intake pulsation (to be explained below).

Like connecting pipe 2, additional pipe 4 is also generally cylindrical in shape. Additional pipe 4 is formed in an appropriate shape so that the resonance frequency of the air through a structure comprised of additional pipe 4 and elastic membrane member 8 (hereinafter referred to as the second resonance frequency) corresponds to a second frequency selected from the plurality of frequencies of the intake pulsation (to be explained below).

A first opening at one end of additional pipe 4 is connected via connecting pipe connector 6 to connecting pipe 2, and a second opening at the other end of additional pipe 4 opens to outside air.

Like connecting pipe 2 and additional pipe 4, connecting pipe connector 6 is also generally cylindrical in shape, and is connected between open ends of connecting pipe 2 and additional pipe 4.

Elastic membrane member 8 and contact member 10 are arranged inside connecting pipe connector 6. The structure of elastic membrane member 8 and contact member 10 will be explained below.

The structure of intake duct 12 and parts related to intake duct 12 will now be explained. Intake duct 12 forms an intake path from the external air to an engine 14. Intake duct 12 contains an air cleaner 16 and a throttle chamber 18. A first opening at one end of intake duct 12 is connected via a surge tank 20 and intake manifold 22 (to be explained below) to cylinders 24 of engine 14. A second opening at the other end of intake duct 12 opens to the outside air. Intake manifold 22 and cylinders 24 are connected via engine inlet ports that pass from cylinders 24 to an outer surface of engine 14.

Air cleaner 16 contains an oiled filter, e.g., or another suitable filter element suitable for cleaning the air flowing from the second opening of intake duct 12 as the air passes through the filter element so as to remove the debris contained in the air.

Throttle chamber 18 is attached between air cleaner 16 and surge tank 20, and is operatively connected to an accelerator pedal (not shown in the figure). Throttle chamber 18 adjusts an air flow rate from air cleaner 16 to surge tank 20 that corresponds to the amount of accelerator pedal depression. When the amount of the accelerator pedal depression is less, the air flow rate from air cleaner 16 to surge tank 20 is decreased (hereinafter to be referred to as a non-rapid acceleration mode), so that an intake vacuum generated in air inside intake duct 12 is reduced. Here, the phrase "intake vacuum" refers to a vacuum generated in intake duct 12 when engine 14 draws in air. A decrease in the intake vacuum means a decrease in an absolute value of the vacuum in intake duct 12, that is, an increase in the pressure inside intake duct 12. In contrast, as the amount of the accelerator pedal depression is increased, the air flow rate from air cleaner 16 to surge tank 20 is increased (hereinafter to be referred to as a rapid acceleration mode), so that the intake vacuum generated in air in intake duct 12 is increased.

During the intake phase, engine 14 draws in air that has flowed in from the second opening of intake duct 12 and is present inside intake duct 12 via surge tank 20 and intake manifold 22 to various cylinders 24. Also, in conjunction with the intake operation, engine 14 acts as a source of pressure that generates an intake pulsation in the air in intake duct 12, which produces a suction noise. Here, the intake pulsation that takes place in conjunction with the intake operation of engine 14 is a pressure variation that is generated in the air in intake duct 12, and this variation in pressure is composed of a plurality of variations in pressures that occur at different frequencies. That is, the intake pulsation that takes place in conjunction with the intake operation of engine 14 is composed of a plurality of intake pulsations that occur at different frequencies. In the present embodiment, engine 14 is assumed to be a 4-cylinder inline engine. However, the structure of engine 14 is not limited to this type.

Figure 2:
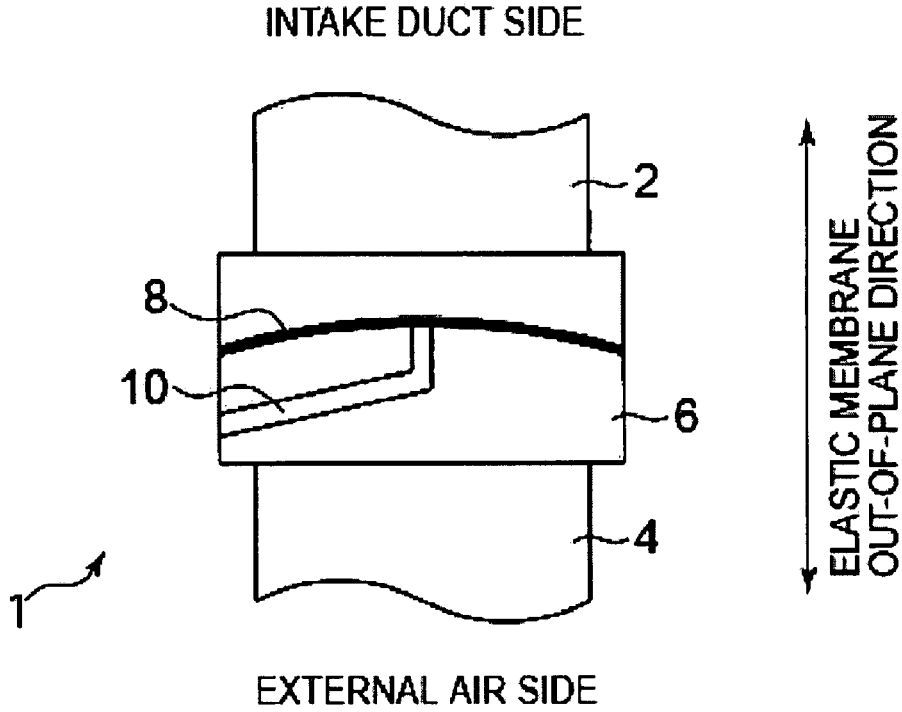
FIG. 2 is an enlarged perspective view of a connecting pipe connector from encircled area II of FIG. 1.

FIG. 2 is an enlarged perspective view of connecting pipe connector 6 and its surroundings from encircled area II of FIG. 1. As shown in FIG. 2, elastic membrane member 8 and contact member 10 are arranged inside connecting pipe connector 6.

Elastic membrane member 8 is made of rubber, e.g., or another elastic material, and is in a general form of a disk. Elastic membrane 8 is attached along an inner peripheral surface of connecting pipe connector 6, and blocks connecting pipe 2. Elastic deformation of elastic membrane member 8 takes place corresponding to the variation in the intake vacuum generated in the air in intake duct 12 during the intake phase of engine 14. Elastic membrane 8 vibrates in an out-of-plane direction. Here, a variation in the intake vacuum occurs when the air flow rate in intake duct 12 changes and when intake pulsation occurs. Elastic membrane member 8 may be substantially circular or elliptical in shape.

In one embodiment, contact member 10 is a rod-shaped member that contains a single bend. Contact member 10 is shaped according to the magnitude of the variation in intake vacuum generated in the air inside intake duct 12. Further, contact member 10 is in contact with the surface of elastic membrane member 8 on a side disposed away from intake duct 12 (hereinafter referred to as external-air-side surface). Elastic membrane member 8 is elastically deformed toward the side of intake duct 12 by a prescribed distance. One end part of contact member 10 is attached to the inner peripheral surface of connecting pipe connector 6 the external-air side, outboard of an attachment point of elastic membrane member 8. The other end part of contact member 10 is set so that the surface of contact member 10 is against the part of elastic membrane member 8 that includes its center on the external air side. The shape of contact member 10 is not limited to the aforementioned shape. For example, contact member 10 may have two or more bends or no bends.

The shape of contact member 10 will be explained below in more detail with reference to FIGS. 3-8.

Figure 3:
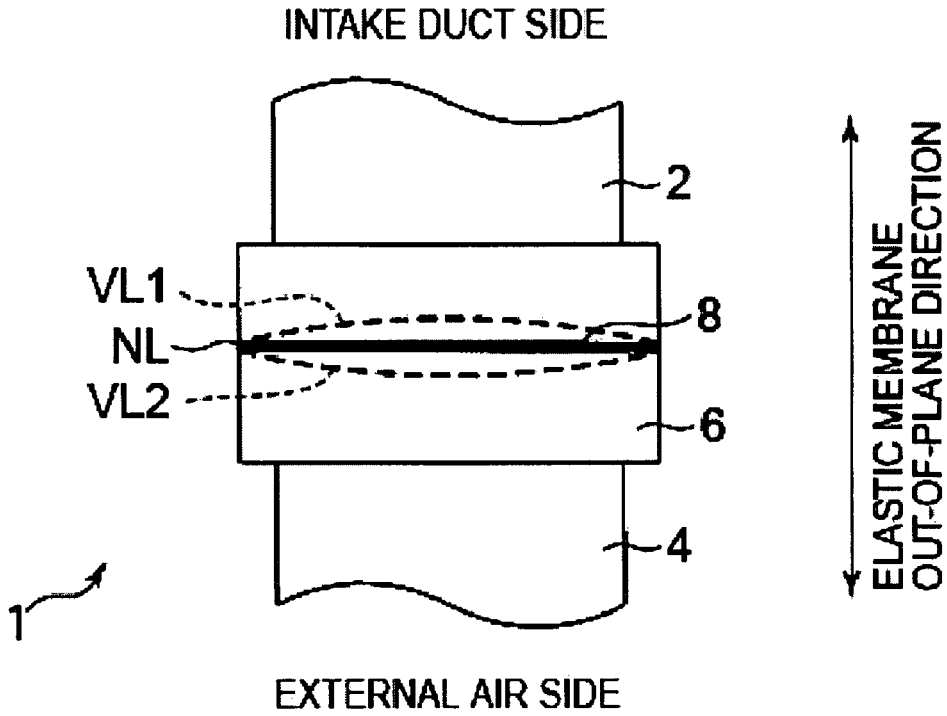
FIG. 3 is a diagram illustrating the state of an elastic membrane member in a non-rapid acceleration mode.
Figure 4:
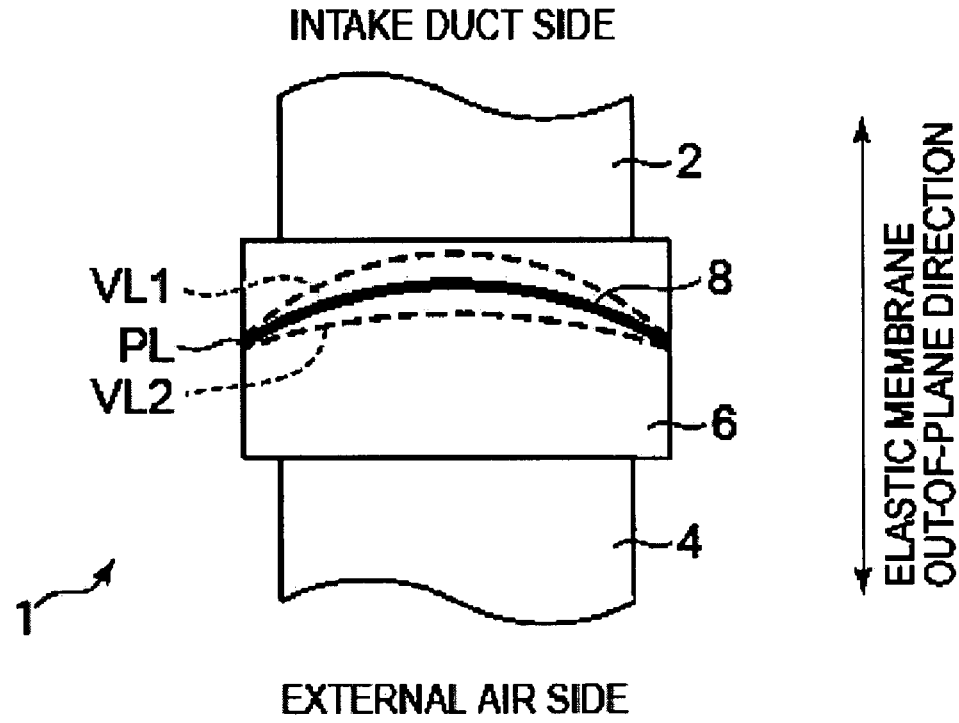
FIG. 4 is a diagram illustrating the state of the elastic membrane member in a rapid acceleration mode.

FIGS. 3 and 4 illustrate in detail connecting pipe connector 6 of amplification device 1 without contact member 10. FIG. 3 is a diagram illustrating the state of elastic membrane member 8 in the non-rapid acceleration mode. FIG. 4 is a diagram illustrating the state of elastic membrane member 8 in the rapid acceleration mode.

As shown in FIG. 3, in the non-rapid acceleration mode an intake vacuum is generated by the air inside intake duct 12 during the intake phase of engine 14. Consequently, elastic membrane member 8 vibrates in the out-of-plane direction corresponding to the intake pulsation relative to a neutral position (the position indicated by solid line NL in FIG. 3), that is, the position in which there is no elastic deformation of elastic membrane member 8. FIG. 3 also shows the range of the vibration in the out-of-plane direction of elastic membrane member 8 in the non-rapid acceleration mode, which is indicated by the two broken lines VL1 and VL2. Here, VL1 represents the position of maximum amplitude of elastic deformation of elastic membrane member 8 toward intake duct, and VL2 represents the position of maximum amplitude of elastic deformation of elastic membrane member 8 toward the external air side.

In contrast, as shown in FIG. 4, the intake vacuum generated by the air in intake duct 12 during the intake phase of engine 14 is higher in the rapid acceleration mode than in the non-rapid acceleration mode. As a result, elastic membrane member 8 vibrates in the out-of-plane direction corresponding to the intake pulsation relative to the position pulled toward the intake duct side (the position indicated by solid line PL in FIG. 4), that is, the position where elastic membrane member 8 is elastically deformed toward the intake duct side from neutral position. In FIG. 4, the range of the vibration in the out-of-plane direction of elastic membrane member 8 in the rapid acceleration mode is indicated by the two broken lines VL1 and VL2. Here, VL1 represents the position of maximum amplitude of the elastic deformation of elastic membrane member 8 toward the side of intake duct 12, and VL2 represents the position of maximum amplitude of the elastic deformation of elastic membrane member 8 toward the external air side.

Consequently, with respect to the amplification device 1 without contact member 10, although the positions denoted as the reference position of vibration are different, in both the non-rapid acceleration mode and rapid acceleration mode, elastic membrane member 8 vibrates in the out-of-plane direction corresponding to the intake pulsation. Since elastic membrane member 8 vibrates in the out-of-plane direction, a variation in pressure of the air takes place on the external air side with respect to elastic membrane member 8, and this variation in pressure of the air is perceived as sound. That is, the suction noise is amplified. In addition, since the intake pulsation at the first frequency and the intake pulsation at the second frequency are amplified, the amplified suction noise is emitted from the second opening of additional pipe 4.

Figure 5:
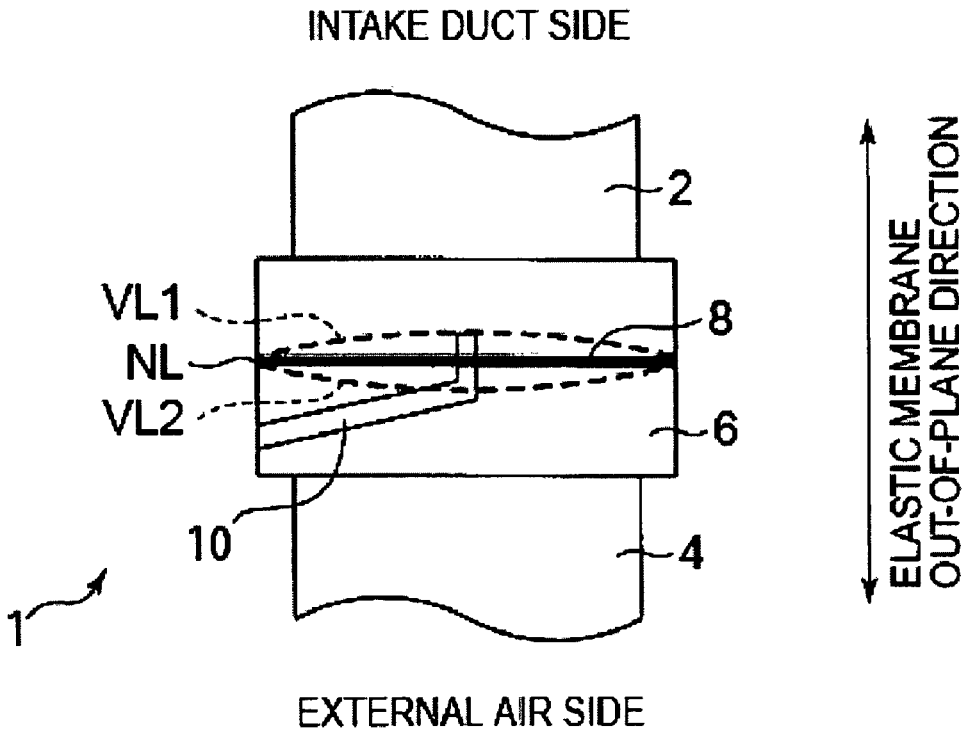
FIG. 5 is a diagram illustrating the state of the elastic membrane member in the non-rapid acceleration mode.
Figure 6:
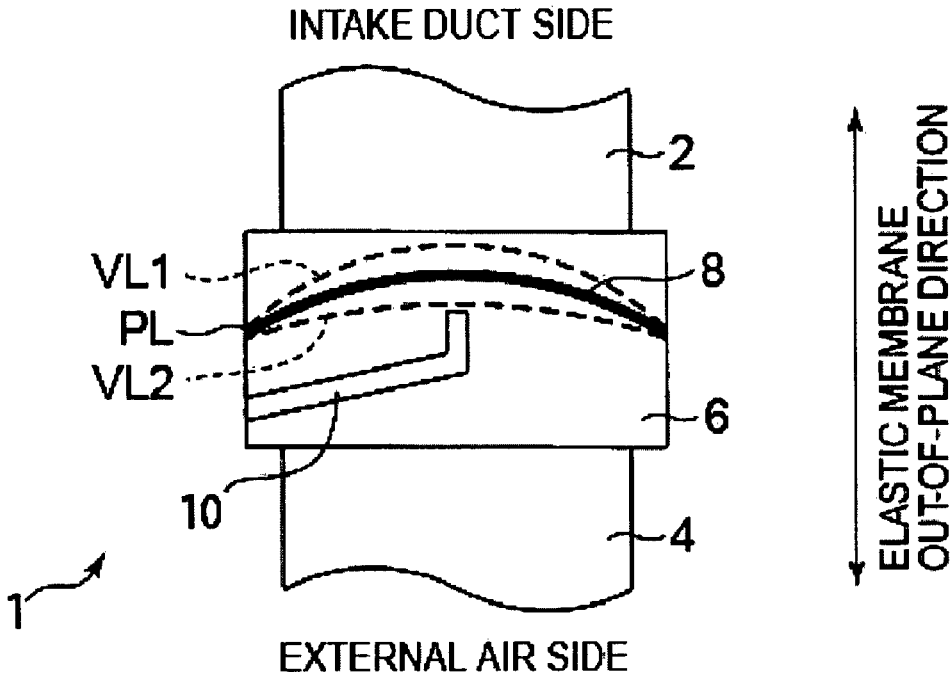
FIG. 6 is a diagram illustrating the state of the elastic membrane member in the rapid acceleration mode.

FIGS. 5 and 6 illustrate in detail the structure of amplification device 1 for amplifying suction noise that is equipped with a contact element 10. More specifically, FIG. 5 is a diagram illustrating the state of elastic membrane member 8 in a non-rapid acceleration mode. FIG. 6 is a diagram illustrating the state of elastic membrane member 8 in a rapid acceleration mode.

As shown in FIG. 5, contact member 10 is formed in such a shape that it contacts elastic membrane member 8 from the external air side. The contact includes contacting part of elastic membrane member 8, including its center, against a surface of elastic membrane member 8 on the external air side, and elastic membrane member 8 is made to undergo elastic deformation toward the intake duct side from the neutral position (the position indicated by solid line NL in FIG. 5).

As far as the positions of elastic deformation of elastic membrane member 8 toward the intake duct side by contact member 10 is concerned, in amplification device 1 that includes a contact member, the center of elastic membrane member 8 reaches position VL1 of the maximum amplitude of the elastic deformation of elastic membrane member 8 toward the intake duct side in the non-rapid acceleration mode (see FIG. 3). That is, the prescribed distance that contact member 10 elastically deforms elastic membrane member 8 toward the side of intake duct 12 is equal to the distance when the center of elastic membrane member 8 reaches position VL1 of the maximum amplitude of the elastic deformation of elastic membrane member 8 toward the intake duct side in the non-rapid acceleration mode, in the amplification device 1 without contact member 10. In FIG. 5, in amplification device 1 that is equipped with contact member 10, the range of the vibration in the out-of-plane direction of elastic membrane member 8 during the non-rapid acceleration mode is indicated by the two broken lines VL1 and VL2. Here, VL1 represents the position of maximum amplitude of the elastic deformation of elastic membrane member 8 toward the intake duct side, and VL2 represents the position of maximum amplitude of elastic membrane member 8 toward the external air side.

As shown in FIG. 6, contact member 10 is formed with an appropriate shape such that the position of contact member 10 facing elastic membrane member 8 is further toward the external air side than maximum amplitude position VL2 of the elastic deformation of elastic membrane member 8 toward the external air side during the rapid acceleration mode. In FIG. 6, the range of the vibration in the out-of-plane direction of elastic membrane member 8 in the rapid acceleration mode is indicated by the two broken lines VL1 and VL2. Here, VL1 represents the position of maximum amplitude of the elastic deformation of elastic membrane member 8 toward the intake duct side, and VL2 represents the position of maximum amplitude of elastic membrane member 8 toward the external air side.

Consequently, in the non-rapid acceleration mode, since contact member 10 is in contact with elastic membrane member 8, the vibration of elastic membrane member 8 due to intake pulsation is suppressed, but in rapid acceleration mode, elastic membrane member 8 vibrates in the out-of-plane direction due to the intake pulsation since contact member 10 is not in contact with elastic membrane member 8.

The operation of amplification device 1 will be explained below.

When engine 14 is turned on, the intake pulsation in conjunction with the intake operation of engine 14 is propagated via intake manifold 22 and surge tank 20 into the air present inside intake duct 12.

The intake pulsations at plural frequencies that form the intake pulsation generated in conjunction with the intake operation of engine 14 are propagated via connecting pipe 2 to elastic membrane member 8. As a result, elastic membrane member 8 subjected to the propagated intake pulsation vibrates in the out-of-plane direction (see FIG. 2).

Due to the vibration of elastic membrane member 8 in the out-of-plane direction, variations in air pressure take place on the external air side with respect to elastic membrane member 8. The variations of the air pressure are perceived as sound, that is, the suction noise is amplified. In this case, the intake pulsation at the first frequency corresponds with the intake pulsation at the first resonance frequency generated due to the structure comprised of connecting pipe 2 and elastic membrane member 8, and the intake pulsation at the second frequency corresponds to the intake pulsation at the second resonance frequency generated by the structure comprised of additional pipe 4 and elastic membrane member 8. As a result, with respect to the intake pulsation at other frequencies, the intake pulsation at the first and second frequencies is more greatly amplified, and the amplified suction noise is emitted from the second open end of additional pipe 4 to the external air.

Here, in the non-rapid acceleration mode, the intake vacuum in intake duct 12 is low. Also, contact member 10 is formed with an appropriate shape such that it makes contact with elastic membrane member 8 from the external air side, it makes contact with the part of elastic membrane member 8 that includes the center, against the surface of elastic membrane member 8 on the external air side, and elastic membrane member 8 is made to deform elastically toward the intake duct side from the neutral position. Also, the position of elastic deformation of elastic membrane member 8 toward the intake duct side by due to contact member 10 is the maximum amplitude position VL1 of the elastic deformation of elastic membrane member 8 to the intake duct side in the non-rapid acceleration mode in the embodiment of amplification device 1 that is without contact element 10. As a result, in the non-rapid acceleration mode, contact member 10 is in contact with elastic membrane member 8 so that it is possible to suppress the vibration of elastic membrane member 8 due to the intake pulsation, and to suppress the effect of amplifying the suction noise by the amplification device (see FIG. 5).

In contrast, in the rapid acceleration mode, the intake vacuum applied to the air in intake duct 12 during the intake phase of engine 14 is higher than that in the non-rapid acceleration mode. Also, the position of the part of contact member 10 facing elastic membrane member 8 is formed on the external air side further from maximum amplitude position VL2 of the elastic deformation of elastic membrane member 8 toward the external air side in the rapid acceleration mode. Consequently, in the rapid acceleration mode, elastic membrane member 8 does not make contact with contact member 10, so that elastic membrane member 8 vibrates in the out-of-plane direction, relative to the position where elastic deformation takes place toward the intake duct side from the neutral position. As a result, the amplified suction noise is emitted to the external air from the second opening of additional pipe 4 (see FIG. 6).

In amplification device 1 in the present embodiment, engine 14 acts as a pressure source that generates the variation in pressure in the air in intake duct 12. However, the pressure source for generating the variation in pressure in the air in intake duct 12 is not limited to this scheme. For example, the pressure source may also be a pump. The main point is that amplification device 1 of the present embodiment may be applied to a system that has a draft tube, and generates a variation in pressure in the air in said draft tube.

Also, in amplification device 1 in the present embodiment, the shape of contact member 10 is such that it makes contact with the part containing the center of elastic membrane member 8 so as to be positioned against the surface of elastic membrane member 8 on the external air side. However, contact member 10 is not limited to this shape. That is, the shape of contact member 10 may be such that it is in contact with other portions of elastic membrane member 8, excluding the center, but in contact with the surface of elastic membrane member 8 on the external air side.

Also, amplification device in the present embodiment contains connecting pipe connector 6. However, the present embodiment is not limited to this scheme. One may also adopt a structure without connecting pipe connector 6. In this case, for example, while connecting pipe 2 and additional pipe 4 are directly connected to each other by means of welding or the like, elastic membrane member 8 is arranged in connecting pipe 2, and contact member 10 is set inside connecting pipe 2 at a position further toward the external air side than elastic membrane member 8, or inside additional pipe 4.

Since the elastic membrane member of amplification device 1 of the present embodiment is elastically deformed by contact member 10 toward the draft tube side, it is possible to change the state of contact between contact member 10 and elastic membrane member 8 corresponding to the magnitude of the change in the intake vacuum generated in the air inside intake duct 12. Consequently, in the non-rapid acceleration mode when the intake vacuum applied to the air in intake duct 12 is low, due to the state of contact between contact member 10 and elastic membrane member 8, the vibration of elastic membrane member 8 is suppressed, and the effect of amplifying the suction noise is reduced. Also, in the rapid acceleration mode, when the intake vacuum applied to the air inside intake duct 12 is higher than that in the non-rapid acceleration mode, since contact member 10 is not in contact with elastic membrane member 8, the vibration of elastic membrane member 8 is not suppressed, and the elastic membrane member 8 vibrates in the out-of-plane direction, so that the effect of amplifying the suction noise may be realized.

Consequently, in the non-rapid acceleration mode when silence is to be maintained, it is possible to reduce the effect of amplifying the suction noise. And, on the other hand, in the rapid acceleration mode, the amplified suction noise is emitted from the second opening of additional pipe 14 to the external air. As a result, it is possible both to guarantee substantial silence during the non-rapid acceleration mode and to amplify the suction noise during the rapid acceleration mode. As a result, it is possible to produce a sports-car sound without disturbing people riding in the vehicle.

Also, since the structure is simple, it is possible both to provide substantial silence during the non-rapid acceleration mode and to amplify the suction noise during rapid acceleration mode without significantly increasing the cost.

Contact member 10 of amplification device 1 for amplifying suction noise of the present embodiment is shaped so that it makes contact with the part of the surface of the elastic membrane member on the external air side that includes the center of the elastic membrane member 8 on the external air side. Elastic membrane member 8 is made to undergo elastic deformation further toward the intake duct side from the neutral position due to the positioning of contact member 10.

Consequently, it is possible to restrain the elastic deformation of the center of elastic membrane member 8 at the position of elastic membrane member 8 where the amplitude corresponding to the variation in the intake vacuum generated in the air in intake duct 12 is maximum. As a result, it is possible to reliably suppress the vibration in the out-of-plane direction of elastic membrane member 8.

Consequently, in the non-rapid acceleration mode, it is possible to reliably reduce the effect of amplifying the suction noise, and it is possible to substantially maintain silence in the non-rapid acceleration mode.

Also, for amplification device 1 in the present embodiment, since the first opening of connecting pipe 2 is blocked by an elastic membrane member 8, the outflow of the air drawn in from intake duct 12 may be prevented. As a result, it is possible to prevent a decrease in the intake rate of engine 14.

Embodiment 2

A second embodiment will now be described.

Figure 7:
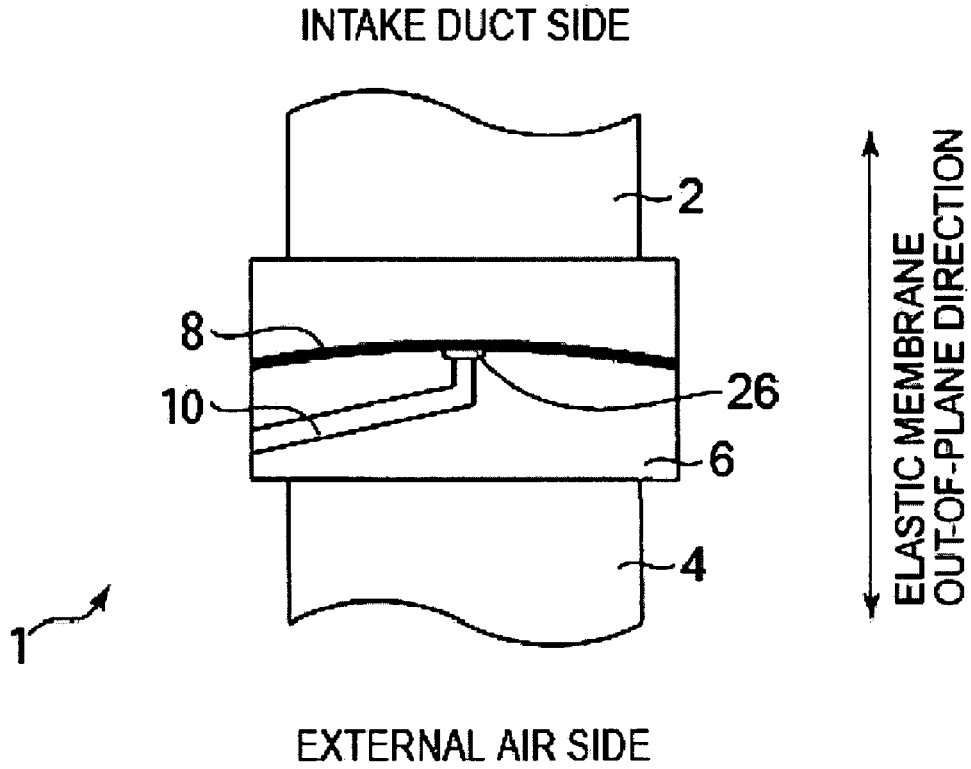
FIG. 7 is a perspective view of the connecting pipe connector for a second embodiment of an amplification device.

FIG. 7 is a diagram illustrating the structure of a second embodiment of an amplification device 1 for amplifying suction noise. More specifically, FIG. 7 is a perspective view illustrating connecting pipe connector 6 and its surroundings.

As shown in FIG. 7, the structure of amplification device in the present embodiment is generally the same as that of Embodiment 1, except for the structure of elastic membrane member 8. That is, elastic membrane member 8 in the present embodiment has a buffer 26 that is set at the part facing contact member 10 on the surface of elastic membrane member 8 on the external air side and is included between elastic membrane member 8 and contact member 10.

Buffer 26 is made of rubber, for example, or another elastic material. Since elastic membrane member 8 and contact member 10 make indirect contact with each other via buffer 26, the local stress generated in elastic membrane member 8 may be reduced.

The remaining features of the structure are the same as those in Embodiment 1.

The operation of the second embodiment will be explained below. In the following, since, except for elastic membrane member 8, the structure is the same as that of the Embodiment 1, only the operation of the different parts will be explained.

As engine 14 is turned on, the intake pulsation in conjunction with the intake operation of engine 14 is propagated via intake manifold 22 and surge tank 20 into the air inside intake duct 12 (see FIG. 1).

Here, in the non-rapid acceleration mode, the intake vacuum in intake duct 12 is lower, and contact member 10 and elastic membrane member 8 are in contact with each other via buffer 26, so that the vibration of elastic membrane member 8 is suppressed. This causes amplification of the suction noise by amplification device 1 to be effectively suppressed. In this case, when elastic membrane member 8 and contact member 10 are indirectly in contact with each other via buffer 26, buffer 26 can reduce the local stress generated in elastic membrane member 8 (see FIG. 7).

As a result, it is possible to reduce damage to elastic membrane member 8 in the non-rapid acceleration mode (see FIG. 7). As a result, it is possible to improve the durability of elastic membrane member 8.

In this embodiment, in amplification device 1, buffer 26 is set on the part facing contact member 10 on the surface of elastic membrane member 8 on the external air side. However, the present embodiment is not limited to this scheme. Essentially, it is only required that buffer 26 be set at least on the part facing contact member 10 on the surface of elastic membrane member 8 on the external air side. For example, it may be set on the part facing contact member 10 and also on the part not facing contact member 10 on the surface of elastic membrane member 8 on the external air side. Thus, even if contact member 10 loses its shape for some reason, it is still possible to prevent direct contact between elastic membrane member 8 and contact member 10.

Embodiment 3

Figure 8:
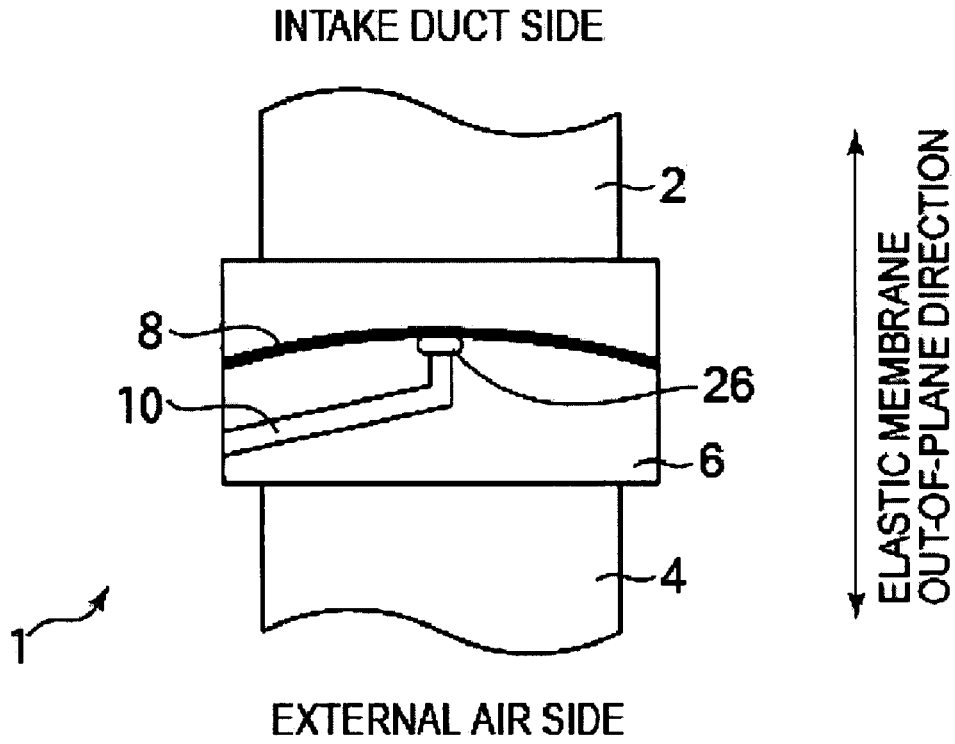
FIG. 8 is a diagram illustrating the structure of a third embodiment of a connecting pipe connector for an amplification device.

A third embodiment of the amplification device 1 will now be explained. FIG. 8 is a diagram illustrating the structure of the third embodiment of connecting pipe connector 6 for amplification device 1.

As shown in FIG. 8, the structure of amplification device 1 for amplifying suction noise in the third embodiment is generally the same as that of the first embodiment, except for the structure of contact member 10. That is, in the present embodiment, contact member 10 has buffer 26 set at a part facing elastic membrane member 8, and it is set between elastic membrane member 8 and contact member 10.

Buffer 26 is made of rubber, for example, or another elastic material. Since elastic membrane member 8 and contact member 10 make indirect contact with each other via buffer 26, the local stress generated in elastic membrane member 8 is reduced.

The remaining features of the structure of the third embodiment are generally the same as those in the first embodiment.

Operation of the third embodiment will be explained below. In the following, except for contact member 10, since the structure is the same as that of the first embodiment, only the operation those that differ between the two embodiments will be explained below (FIG. 1).

As engine 14 is turned on, the intake pulsation in conjunction with the intake operation of engine 14 is propagated via intake manifold 22 and surge tank 20 into the air inside intake duct 12.

Here, in non-rapid acceleration mode, the intake vacuum in intake duct 12 is lower, and contact member 10 and elastic membrane member 8 are in contact with each other via buffer 26, so that the vibration of elastic membrane member 8 is suppressed, and the effect of amplifying the suction noise by amplification device 1 is effectively suppressed.

In this case, contact member 10 has buffer 26 set on the part facing elastic membrane member 8, and since elastic membrane member 8 and contact member 10 are indirectly in contact with each other via buffer 26, buffer 26 can reduce the local stress generated in elastic membrane member 8 (see FIG. 8).

As a result, it is possible to reduce damage to elastic membrane member 8 in a non-rapid acceleration mode (see FIG. 8). As a result, it is possible to improve the durability of elastic membrane member 8.

In amplification device 1 for amplifying suction noise in the second embodiment, only elastic membrane member 8 has a buffer 26, and in amplification device 1 in the third embodiment, only contact member 10 has buffer 26. However, the present invention is not limited to these schemes. For example, it is also possible for elastic membrane member 8 to have a buffer 26 and for contact member 10 to also have a buffer 26.

In amplification device 1 for amplifying suction noise in the third embodiment, buffer 26 is set on a part of contact member 10 facing elastic membrane member 8. However, the position for setting buffer 26 is not limited to this position. Essentially, it is only required that buffer 26 at least be set on the part of contact member 10 that faces elastic membrane member 8. For example, it may be set on both of the part of contact member 10 facing elastic membrane member 8 and a part that does not face elastic membrane member 8. Thus, even if contact member 10 deforms for some reason it is still possible to prevent direct contact between elastic membrane member 8 and contact member 10.

Embodiment 4

Figure 9:
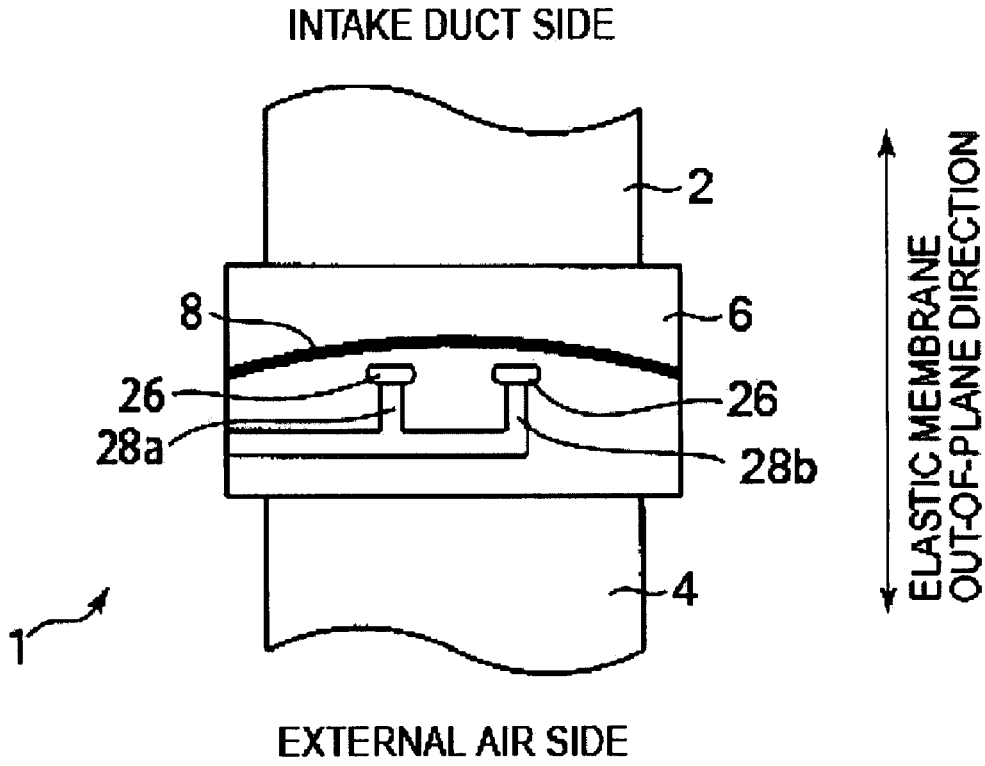
FIG. 9 is a diagram illustrating the structure of a fourth embodiment of a connecting pipe connector for an amplification device.

A fourth embodiment will now be explained, referring to FIG. 9. FIG. 9 is a diagram illustrating a perspective view of the connecting pipe connector 6 for the fourth embodiment of amplification device 1.

As shown in FIG. 9, the structure of amplification device 1 for amplifying suction noise in the fourth embodiment is the same as that of the first embodiment 1, except for the structure of contact member 10. That is, in the present embodiment, contact member 10 has at least two protruding parts 28*a*, 28*b* that face the surface of elastic membrane member 8 on the external air side.

Each protruding part 28*a*, 28*b* has a buffer 26 set on the part facing elastic membrane member 8. As a result, since elastic membrane member 8 and contact member 10 are in indirect contact with each other via buffer 26, the local stress generated in elastic membrane member 8 may be reduced.

The remaining features of the structure of the fourth embodiment are substantially the same as those in the first embodiment.

The operation of the fourth embodiment will be explained below. In the following, since except for contact member 10, the structure is the same as that of the first embodiment, mainly the operation of just those portions that differ between the two embodiments will be explained.

As engine 14 is turned on, the intake pulsation in conjunction with the intake operation of engine 14 is propagated via intake manifold 22 and surge tank 20 into the air inside intake duct 12 (see FIG. 1).

Here, in the non-rapid acceleration mode, the intake vacuum in intake duct 12 is lower, and contact member 10 and elastic membrane member 8 are in contact with each other via buffer 26, so that the vibration of elastic membrane member 8 is suppressed, and the effect of amplifying the suction noise by amplification device 1 is suppressed.

In this embodiment, contact member 10 has two protruding parts 28*a*, 28*b* facing the surface of elastic membrane member 8 on the external air side, and each of protruding parts 28*a*, 28*b* may includes a buffer 26 set on the part facing elastic membrane member 8. In one embodiment, protruding parts 28*a*, 28*b* are spaced apart from one another so as to be arranged on either side of a center portion of elastic membrane 8. Buffer 26 equipped on each of two protruding parts 28*a*, 28*b* may reduce the local stress generated in elastic membrane member 8 when elastic membrane member 8 and contact member 10 make indirect contact with each other via contact member 10.

In amplification device 1, contact member 10 containing two protruding parts 28*a*, 28*b* faces the surface of elastic membrane member 8 on the external air side. However, the present embodiment is not limited to this scheme. That is, contact member 10 may also have a structure in which three or more protruding parts 32 face the surface of elastic membrane member 8 on the external air side.

Also, in amplification device 1 in the present embodiment, each of two protruding parts 28*a*, 28*b* has a buffer 26 set at the part facing elastic membrane member 8. However, the present embodiment is not limited to this scheme. That is, it is not necessary that both protruding parts 28*a*, 28*b* have buffer 26. That is, it is possible for only one of two protruding parts 28*a*, 28*b* to have buffer 26.

In the amplification device 1, contact member 10 includes two contact parts facing the surface of elastic membrane member 8 on the external air side, and each contact part has a buffer 26 set on the part facing elastic membrane member 8. Consequently, in the non-rapid acceleration mode, contact member 10 and elastic membrane member 8 make indirect contact with each other via the two buffers 26. As a result, compared with amplification device 1 in the third embodiment in which contact member 10 and elastic membrane member 8 make indirect contact with each other via one buffer 26, it is possible to further suppress vibration of elastic membrane member 8. As a result, it is possible to further reduce the effect of amplifying the suction noise.

Also, in amplification device 1 in the present embodiment, the two buffers 26 equipped on the two contact parts 28*a*, 28*b* may reduce the local stress when contact member 10 and elastic membrane member 8 makes contact with each other via the buffers 26.

As a result, in the non-rapid acceleration mode, since contact member 10 and elastic membrane member 8 make indirect contact with each other via two buffers 26 compared with amplification device 1 in the third embodiment in which contact member 10 and elastic membrane member 8 are in indirect contact with each other via a single buffer 26, it is possible to further reduce damage to elastic membrane member 8. As a result, it is possible to further improve the durability of elastic membrane member 8.

Embodiment 5

Figure 10:
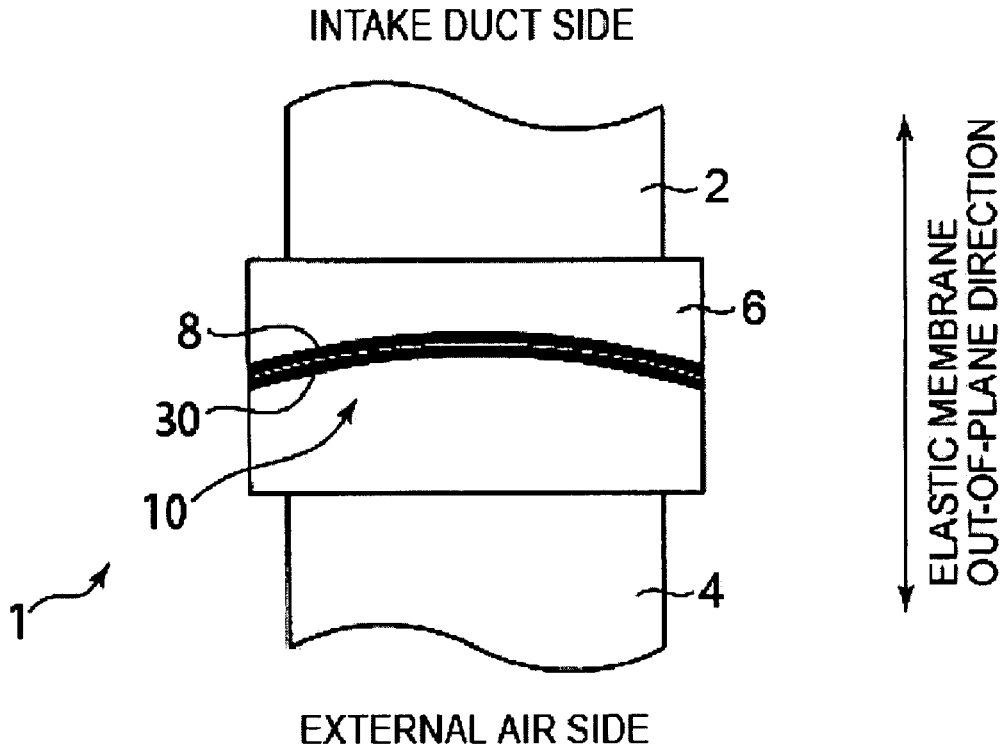
FIG. 10 is a diagram illustrating the structure of a fifth embodiment of a connecting pipe connector for an amplification device.

A fifth embodiment will now be described. FIG. 10 is a diagram illustrating the structure of a connecting pipe connector 6 for amplification device 1 for amplifying suction noise in a fifth embodiment.

As shown in FIG. 10, the structure of amplification device 1 in the present embodiment is generally the same as that of the first embodiment, except for the structure of contact member 10. That is, in the fifth embodiment, contact member 10 has a convex part 30 on the external air side that curves towards the surface of elastic membrane member 8.

Figure 11:
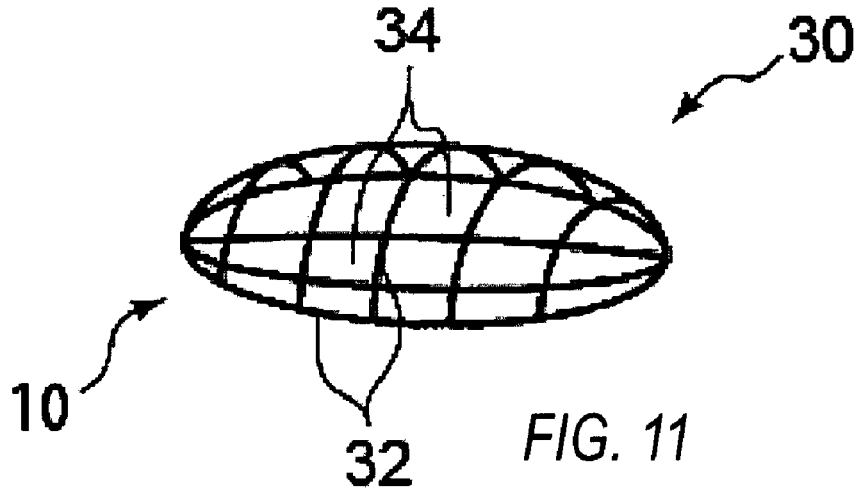
FIG. 11 is an oblique top view of a contact member shown in FIG. 10.

FIG. 11 is an oblique top view of contact member 10. As shown in FIG. 11, convex part 30 has a contacting part 32 that is in contact with the surface of elastic membrane member 8 on the external air side, and a non-contacting part 34 that is not in contact with the surface of elastic membrane member 8 on the external air side.

Contacting part 32 is formed from a plurality of intersecting linear elements that form an overall mesh-like shape. Non-contacting part 34 is made up of a plurality of voids that pass through convex part 30 in the out-of-plane direction of elastic membrane member 8, with the various voids appearing between the plurality of linear elements that form contacting part 32.

The remaining features of the structure are the same as those in the first embodiment.

Operation of the present embodiment will be explained below. In the following discussion, since the structure, except for contact member 10, is generally the same as that of the first embodiment 1, only the operation of the different parts will be explained.

As engine 14 is turned on, the intake pulsation in conjunction with the intake operation of engine 14 is propagated via intake manifold 22 and surge tank 20 into the air inside intake duct 12 (see FIG. 1).

In the first embodiment, in the non-rapid acceleration mode, the intake vacuum in intake duct 12 is lower, and contact member 10 and elastic membrane member 8 are in contact with each other via buffer 26, so that the vibration of elastic membrane member 8 is suppressed, and the effect of amplifying the suction noise by amplification device 1 is suppressed (see FIG. 10).

In the fifth embodiment, contact member 10 has a convex part 30 on the external air side that curves towards the surface of elastic membrane member 8, and a contacting part 32 of convex part 30 that is in contact with the surface of elastic membrane member 8 on the external air side. Contacting part 32 is made up of a plurality linear elements that form an overall mesh-like shape (see FIG. 11).

As a result, in the non-rapid acceleration mode, contacting part 32 composed of plurality of linear elements and elastic membrane member 8 are in contact with each other at plural contact points (see FIG. 10).

On the other hand, in the rapid acceleration mode, elastic membrane member 8 is not in contact with contact member 10, and it vibrates in the out-of-plane direction. In this case, between the plural linear elements that make up contacting part 32, there are plural voids that pass through convex part 30 in the out-of-plane direction of elastic membrane member 8, and the voids make up non-contacting part 34 that is not in contact with the surface of elastic membrane member 8 on the external air side (see FIG. 11).

As a result, in the rapid acceleration mode, elastic membrane member 8 vibrates in the out-of-plane direction. During the vibration, the pulsating air passes through the various voids into additional pipe 4, and the amplified suction noise is emitted from the opening on the other end of additional pipe 4 to the external air (see FIG. 1).

In the amplification device in the present embodiment, the contact member 10 has a convex part 30 on the external air side that curves towards the surface of the elastic membrane member 8, and this convex part 30 has a contacting part in contact with the surface of the elastic membrane member on the external air side. The contacting part is made up plural linear elements 32 and is formed with an overall mesh shape.

Consequently, in the non-rapid acceleration mode, because the contacting part made up of plural linear elements 32 and the elastic membrane member 8 are in contact with each other at plural contact points, compared with the device for amplifying suction noise in the third embodiment in which contact member 10 and elastic membrane member 8 are in indirect contact with each other via a single buffer, it is possible to further suppress the vibration of the elastic membrane member 8. As a result, it is possible to further reduce the effect of amplifying the suction noise.

Also, in the amplification device 1 in the present embodiment, the convex part 30 of contact member 10 has a contacting part formed from plural linear elements 32, and in the non-rapid acceleration mode, the contacting part composed of plural linear elements 32 and the elastic membrane member 8 are in contact with each other at plural contact points.

Consequently, compared with the amplification device 1 in the third embodiment, in which the contact member 10 and the elastic membrane member 8 are in indirect contact with each other via a single buffer, in the present embodiment, it is possible to further reduce damage to the elastic membrane member 8. As a result, it is possible to further improve the durability of the elastic membrane member 8.

Embodiment 6

Figure 12:
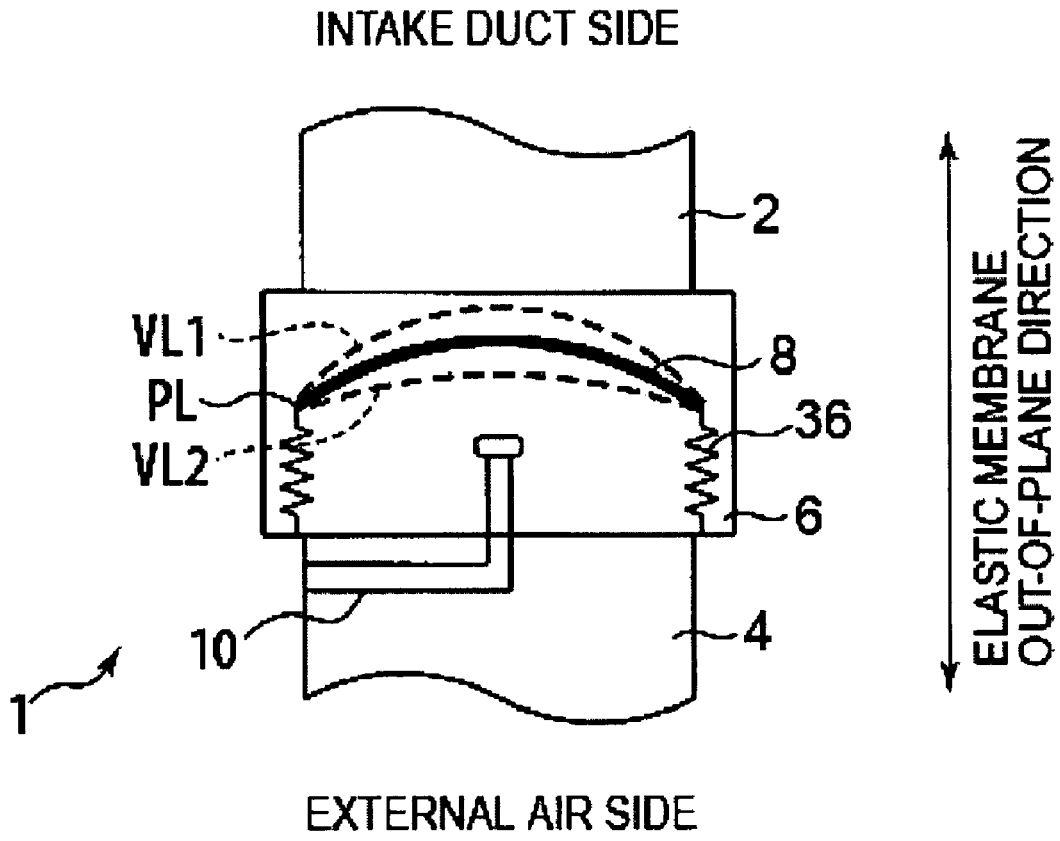
FIG. 12 is a diagram illustrating the structure of a sixth embodiment of a connecting pipe connector for an amplification device.

A sixth embodiment will be explained. FIG. 12 is a diagram illustrating the structure of connecting pipe connector 6 for a sixth embodiment of the amplification device 1 for amplifying suction noise.

As shown in FIG. 12, the structure of amplification device 1 for amplifying suction noise in the present embodiment is generally the same as that of the first embodiment, except for the structure of elastic membrane member 8 and contact member 10. FIG. 12 also shows the range of the vibrations of elastic membrane member 8 in the out-of-plane direction in the rapid acceleration mode, is indicated by the two broken lines VL. Here, VL1 represents the position of maximum amplitude the elastic deformation of elastic membrane member 8 towards the intake duct side, and VL2 represents the position of maximum amplitude of the elastic deformation of elastic membrane member 8 towards the external air side.

Elastic membrane member 8 is supported by a vibration membrane support member 36 inside connecting pipe connector 6. For example, vibration membrane support member 36 may be made of coil springs or other elastic material and has greater rigidity in the axial direction of connecting pipe 2 than elastic membrane member 8. Also, vibration membrane support member 36 elastically deforms in the axial direction of connecting pipe 2 corresponding to the magnitude of the change in the intake vacuum generated in the air inside intake duct 12. More specifically, when the intake vacuum generated in the air in intake duct 12 becomes higher, and elastic deformation of elastic membrane member 8 takes place further towards the intake duct side with respect to the neutral position, elastic deformation takes place towards the intake duct side. Also, the structure is such that when there is no elastic deformation of elastic membrane member 8 further toward the intake duct side from the neutral position, no elastic deformation takes place in the axial direction of connecting pipe 2.

Contact member 10 is attached at one end to the inner peripheral surface of additional pipe 4, and at the part facing elastic membrane member 8, has buffer 26. Buffer 26 reduces the local stress when indirect contact between elastic membrane member 8 and contact member 10 takes place via buffer 26.

The remaining features of the structure are the same as those in the first embodiment 1.

The operation of the present embodiment will be explained below. In the following, since except for contact member 10, the structure is the same as that of the first embodiment, mainly the operation of the different part will be explained.

As engine 14 is turned on, the intake pulsation in conjunction with the intake operation of engine 14 is propagated via intake manifold 22 and surge tank 20 into the air inside intake duct 12 (see FIG. 1). In the first embodiment, in the non-rapid acceleration mode, the intake vacuum in intake duct 12 is lower, and contact member 10 and elastic membrane member 8 are in contact with each other via buffer 26, so that vibration of elastic membrane member 8 is suppressed, and the effect of amplifying the suction noise by amplification device 1 is suppressed.

In the sixth embodiment, contact member 10 has buffer 26 arranged at the part facing elastic membrane member 8. Said buffer 26 reduces the local stress generated when elastic membrane member 8 and contact member 10 make contact with each other via buffer 26 (see FIG. 12).

On the other hand, in the rapid acceleration mode, the intake vacuum generated in the air in intake duct 12 during the intake phase of the engine 14 is higher than that in the non-rapid acceleration mode. Also, contact member 10 is shaped such that the position of the part facing elastic membrane member 8 is further toward the external air side than position VL2 of the maximum amplitude of the elastic deformation of elastic membrane member 8 toward the external air side in the rapid acceleration mode.

Also, elastic membrane member 8 is supported inside connecting pipe connector 6 by vibration membrane support member 36, which has greater rigidity in the axial direction of connecting pipe 2 than elastic membrane member 8, and which elastically deforms in the axial direction of connecting pipe 2 corresponding to the magnitude of variation in the intake vacuum generated in the air inside intake duct 12.

As a result, in the rapid acceleration mode, elastic membrane member 8 elastically deforms from the neutral position further towards the intake duct side, so that vibration membrane support member 36 also makes elastic deformation further towards the intake duct side. As a result, the distance between elastic membrane member 8 and contact member 10 becomes greater than that when elastic deformation towards the intake duct side occurs only for elastic membrane member 8 (see FIG. 12).

For the amplification device 1 in the present embodiment, the elastic membrane member 8 is supported inside the connecting pipe 2 by a vibration membrane supporting member 36 having greater rigidity in the axial direction of the connecting pipe 2 than the elastic membrane member 8, and which elastically deforms in the axial direction of the connecting pipe 2 corresponding to the magnitude of variation in the intake vacuum generated in the air inside the intake duct 12.

Consequently, in the rapid acceleration mode, the elastic membrane member 8 and the contact member 10 can be reliably separated from each other. As a result, it is possible to improve the effect of amplifying the suction noise in the rapid acceleration mode. Consequently, it is possible both to guarantee silence in the non-rapid acceleration mode and to amplify the suction noise in the rapid acceleration mode.

Embodiment 7

The seventh embodiment will be explained. FIG. 13 is a diagram illustrating the structure of connecting pipe connector 6 for a seventh embodiment of amplification device 1 for amplifying suction noise.

As shown in FIG. 13, the structure of amplification device 1 for amplifying suction noise in the present embodiment is generally the same as that of the first embodiment, except for the structure of contact member 10. That is, contact member 10 in the present embodiment includes a rotating mechanism 38 attached to an outer peripheral surface of connecting pipe connector 6. Also, as shown in FIG. 13, the range of vibration in the out-of-plane direction of elastic membrane member 8 during the rapid acceleration mode is indicated by two broken lines VL. Here, VL1 represents the position of the maximum amplitude of the elastic deformation of elastic membrane member 8 towards the intake duct side, and VL2 represents the position of the maximum amplitude of the elastic deformation of elastic membrane member 8 towards the external air side.

For example, rotating mechanism 38 may include a motor. Corresponding to the magnitude of variation in the intake vacuum generated in the air inside the intake duct, contact member 10 is rotated around an axis extending in the radial direction of connecting pipe connector 6. Rotating mechanism 38 has the function of changing the position of contact member 10 with respect to elastic membrane member 8. More specifically, in non-rapid acceleration mode, the position of contact member 10 with respect to elastic membrane member 8 is the position of maximum amplitude of elastic membrane member 8 towards the intake duct side in non-rapid acceleration mode. On the other hand, in the rapid acceleration mode, the position of contact member 10 with respect to elastic membrane member 8 is further towards the external air side than position VL2 of maximum amplitude of the elastic deformation of elastic membrane member 8 toward the external air side in rapid acceleration mode. In FIG. 13, the direction of rotation of contact member 10 is indicated by a bidirectional arrow.

Contact member 10 has buffer 26 set at the part facing elastic membrane member 8. Buffer 26 reduces the local stress generated when elastic membrane member 8 and contact member 10 make indirect contact via buffer 26. The remaining features of the structure of the seventh embodiment are the same as those in the first embodiment 1.

Operation of the present embodiment will be explained below. In the following, since, except for contact member 10, the structure is generally the same as that of the first embodiment, mainly just the operation of the differing portions will be explained.

As engine 14 is turned on, the intake pulsation in conjunction with the intake operation of engine 14 is propagated via intake manifold 22 and surge tank 20 into the air present inside intake duct 12 (see FIG. 1). Here, in non-rapid acceleration mode, because the intake vacuum in intake duct 12 is lower, due to rotating mechanism 38, the position of contact member 10 with respect to elastic membrane member 8 is the position of maximum amplitude of elastic membrane member 8 towards the intake duct side. Since elastic membrane member 8 elastically deforms towards the intake duct side by contact member 10, the vibration of elastic membrane member 8 is suppressed, so that the effect of amplifying the suction noise by amplification device 1 is suppressed. In this case, contact member 10 has buffer 26 set on the part of contact between elastic membrane member 8 and contact member 10 on the surface of elastic membrane member 8 on the external air side. Buffer 26 reduces the local stress generated that takes place in the contact part between 8 and contact member 10 when elastic membrane member 8 and contact member 10 make contact with each (see FIG. 13).

On the other hand, in rapid acceleration mode, the intake vacuum generated in the air in intake duct during the intake phase of the engine is higher than that in non-rapid acceleration mode. As a result, due to rotating mechanism 38, the position of contact member 10 with respect to elastic membrane member 8 moves further towards the external air side than position VL2 of maximum amplitude of the elastic deformation of elastic membrane member 8 toward the external air side in the rapid acceleration mode. Consequently, in the rapid acceleration mode, there is no contact between elastic membrane member 8 and contact member 10, and vibrations in the out-of-plane direction occur relative to the position of elastic deformation further towards the intake duct side than the neutral position. As a result, the amplified suction noise is emitted from the opening on the other end of additional pipe 4 to the external air (see FIG. 13).

In amplification device 1 for amplifying suction noise in the present embodiment, rotating mechanism 38 has a structure such that the position of contact member 10 with respect to elastic membrane member 8 is changed corresponding to the magnitude of variation in the intake vacuum generated in the air inside the intake duct. However, the structure of rotating mechanism 38 is not limited to this scheme. For example, rotating mechanism 38 may also have a structure such that the position of contact member 10 with respect to elastic membrane member 8 is changed corresponding to the amount of the accelerator pedal depression. Also, the structure may be such that the position of contact member 10 with respect to elastic membrane member 8 is changed under ALU control, etc.

Amplification device 1 for amplifying suction noise of the present embodiment has a rotating mechanism that changes the position of the contact member with respect to the elastic membrane member by rotating the contact member around an axis extending in the radial direction of the connecting pipe corresponding to the magnitude of the variation of the intake vacuum generated in the air inside the intake duct.

Consequently, in the non-rapid acceleration mode, the position of the contact member with respect to the elastic membrane member is the position of maximum amplitude of the elastic membrane member towards the intake duct side in the non-rapid acceleration mode. On the other hand, in the rapid acceleration mode, the position of the contact member with respect to the elastic membrane member is the position further towards the intake duct side of the elastic membrane member in the rapid acceleration mode.

Consequently, in the non-rapid acceleration mode, the elastic membrane member and the contact member can make reliable contact with each other, while the in rapid acceleration mode, the elastic membrane member and the contact member are reliably separated. As a result, it is possible both to maintain silence in the non-rapid acceleration mode and to amplify the suction noise in the rapid acceleration mode.

Also, in the amplification device 1 of the present embodiment, for example, by setting the position of the contact member with respect to the elastic membrane member further towards the external air side than the position of maximum amplitude of the elastic membrane member towards the external air side in the rapid acceleration mode, it is possible to ensure reliable separation between the elastic membrane member and the contact member. As a result, it is possible to prevent constant contact between the elastic membrane member and the contact member, so that it is possible to improve the durability of the elastic membrane member.

Embodiment 8

An eighth embodiment 8 will now be explained. FIG. 14 is a diagram illustrating the structure of an eighth embodiment of amplification device 1. As shown in FIG. 14, the structure of amplification device 1 is generally the same as that of the first embodiment, except for the structure of additional pipe 4. That is, in the present embodiment, additional pipe 4 is composed of first additional pipe portion 4*a* and a second additional pipe portion 4*b*.

First additional pipe portion 4*a* and second additional pipe portion 4*b* have different lengths. That is, first additional pipe portion 4*a* is longer than second additional pipe portion 4*b*.

In this embodiment, first additional pipe portion 4*a* and second additional pipe portion 4*b* are formed in appropriate shapes such that the intake pulsation of the second resonance frequency of the structure comprised of first additional pipe portion 4*a*, second additional pipe portion 4*b* and elastic membrane member 8 match the intake pulsation at the second frequency selected from the plurality of intake pulsations at different frequencies. Also, first additional pipe portion 4*a* and second additional pipe portion 4*b* are appropriately shaped to ensure that the suction noise amplified in the rapid acceleration mode has a sound quality appropriate for the audio characteristics of the vehicle. The opening at a first end of first additional pipe portion 4*a* and second additional pipe portion 4*b* are connected to connecting pipe 2 via connecting pipe connector 6. Second openings located at ends opposite of the first end of first additional pipe portion 4*a* and second additional pipe portion 4*b* are open to the external air.

The remaining features of the structure of the eighth embodiment are generally the same as those in the first embodiment 1. The operation of the present embodiment will now be explained. In the following, since except for the structure of additional pipe 4, the structure of the eighth embodiment is generally the same as that of the first embodiment 1, mainly the operation of just those portions that differ between the embodiments will be explained.

As engine 14 is turned on, the intake pulsation in conjunction with the intake phase of engine 14 is propagated via intake manifold 22 and surge tank 20 into the air present inside intake duct 12 (see FIG. 1).

Here, of the plurality of intake pulsations at different frequencies that form the intake pulsation generated in conjunction with the intake operation of engine 14, the selected intake pulsations at the first frequency and the second frequency are propagated via connecting pipe 2 to elastic membrane member 8. As the intake pulsation at the first frequency and the intake pulsation at the second frequency are propagated to it, elastic membrane member 8 vibrates in the out-of-plane direction (see FIG. 2).

In this case, the intake pulsation at the first frequency matches the intake pulsation at the first resonance frequency of the structure comprised of connecting pipe 2 and elastic membrane member 8, and the intake pulsation at the second frequency matches the intake pulsation at the second resonance frequency of the structure composed of first additional pipe portion 4*a*, second additional pipe portion 4*b* and elastic membrane member 8. As a result, the intake pulsations at the first frequency and the second frequency are amplified, and the amplified suction noise is emitted from the second openings on the other end of additional pipe portions 4*a* and 4*b* to the external air (see FIG. 14).

Here, in the non-rapid acceleration mode, the intake vacuum in intake duct 12 is lower, and contact member 10 and elastic membrane member 8 are in contact with each other via buffer 26 (not shown). As a result, the vibration of elastic membrane member 8 is suppressed, so that the effect of amplifying the suction noise by amplification device 1 is suppressed (see FIG. 14).

On the other hand, in the rapid acceleration mode, the intake vacuum generated in the air in intake duct during the intake phase of the engine is higher than that in the non-rapid acceleration mode. As a result, elastic membrane member 8 is not in contact with contact member 10 while it vibrates in the out-of-plane direction. As a result, the amplified suction noise is emitted from the second openings on the additional pipe portions 4*a* and 4*b* to the external air (see FIG. 14).

In the present embodiment, amplification device 1 for amplifying suction noise has additional pipe 4 comprised of first additional pipe portion 4*a* and second additional pipe portion 4*b*. That is, additional pipe 4 is composed of two additional pipe segments. However, the structure of additional pipe 4 is not limited to this scheme. For example, one may also adopt three or more additional pipe segments 4.

In amplification device 1 for amplifying suction noise in the eighth embodiment, since the additional pipe is comprised of a first additional pipe and a second additional pipe, in the rapid acceleration mode, the suction noise is amplified at different frequencies corresponding to the resonance frequency of the first additional pipe and the resonance frequency of the second additional pipe. As a result, for example, it is possible to amplify the suction noise at two or more different engine rotational velocities, and it is possible to adjust the relationship between the engine rotational velocity and the suction noise level so that the effect of producing a pleasant sound directed to the person(s) in the vehicle is enhanced. As a result, it is possible both to maintain silence in the non-rapid acceleration mode and to amplify the suction noise in the rapid acceleration mode, and at the same time, it is possible to generate a suction noise that produces a pleasant sound for people in the vehicle.

Also, in amplification device 1 for amplifying suction noise of the present embodiment, the structure is such that the elastic membrane member is made to elastically deform towards the intake duct side by the contact member, so that the vibrations of the elastic membrane member are suppressed. However, the structure of the amplification device of the present embodiment is not limited to this scheme. That is, other structure may be adopted for elastically deforming the elastic membrane member towards the intake duct side. Examples include, but are not limited to, the use of magnetic force, air jets or other non-contacting means at the surface of the elastic membrane member on the external air side, so that the elastic membrane member is made to elastically deform towards the intake duct side to produce the necessary distance for suppressing the vibration of the elastic membrane member, so that the vibration of the elastic membrane member can be suppressed. Essentially, it is only required that the structure of the amplification device of the present embodiment includes a vibration suppression mechanism that suppresses the vibration of the elastic membrane member by elastically deforming the elastic membrane member towards the intake duct side by a certain amount corresponding to the magnitude of variation in the intake vacuum generated in the air inside the intake duct during the intake phase of the engine.

Embodiment 9

Figure 15:
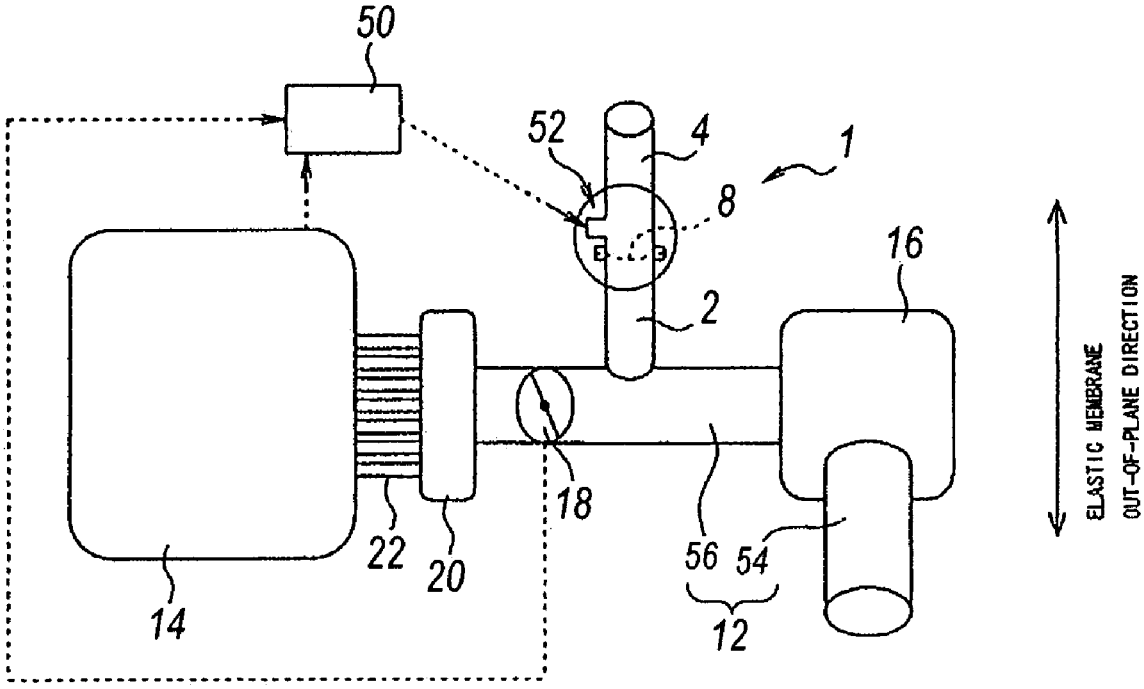
FIG. 15 is a diagram illustrating the structure of a ninth embodiment of an amplification device.

Referring to FIG. 15, a ninth embodiment will be explained. FIG. 15 is a diagram illustrating the structure of amplification device 1. As shown in FIG. 15, amplification device 1 includes connecting pipe 2, additional pipe 4, elastic membrane member 8, an engine control unit 50, and a vibration suppression mechanism 52.

Connecting pipe 2 is generally cylindrical in shape and is attached to the outer peripheral surface of intake duct 12 that may be formed from a draft tube that contains air, while connecting pipe 2 is connected to intake duct 12.

Like connecting pipe 2, additional pipe 4 is also generally cylindrical in shape. Additional pipe is longer than connecting pipe 2. The first opening at one end of additional pipe 4 is connected to connecting pipe 2, and the second opening on the other end of additional pipe 4 is open to the external air.

Elastic membrane member 8 is generally disk-shaped and made of rubber or another suitable elastic material. Elastic membrane member 8 is arranged between connecting pipe 2 and additional pipe 4 and blocks intake manifold 22. Also, since elastic membrane member 8 elastically deforms corresponding to the intake pulsation generated inside intake duct 12, it vibrates in the out-of-plane direction.

The structure of intake duct 12 and the part(s) related to intake duct 12 will now be explained. Intake duct 12 forms the intake path from the external air to engine 14, and is composed of an unfiltered-side intake duct 54 and filtered-side intake duct 56.

A first opening at one end of unfiltered-side intake duct 54 is connected to air cleaner 16. A second opening on the other end of unfiltered-side intake duct 54 is open to the external air.

Filtered-side intake duct 56 has a throttle chamber 18. A first opening at one end of filtered-side intake duct 56 is connected to air cleaner 16, and a second opening on the other end of filtered-side intake duct 56 is connected via surge tank 20 and intake manifold 22 (to be explained below) to the cylinders (not shown in the figure) of engine 14. Also, connecting pipe 2 is connected and attached via filtered-side intake duct 56 onto the outer peripheral surface of filtered-side intake duct 56.

For example, air cleaner 16 has an oil filter or other filter element, so that the air flowing from the opening on the other end of intake duct 12 is cleaned as it flows through the filter element.

Throttle chamber 18 is attached between air cleaner 16 and surge tank 20, and it has a throttle valve (not shown in the figure) connected to the accelerator pedal (not shown in the figure). The throttle valve adjusts the air flow rate from air cleaner 16 to surge tank 20 corresponding to the amount of the accelerator pedal depression. When the amount of the accelerator pedal depression is reduced, the air flow rate of engine 14 is decreased, so that the intake vacuum generated in the air inside intake duct 12 is reduced. On the other hand, as the amount of the accelerator pedal depression is increased, the air flow rate of engine 14 is increased, so that the intake vacuum generated in the air in intake duct 12 is increased.

During the intake phase, engine 14 draws in air that has flowed in from the opening on the other end of unfiltered-side intake duct 54 into filtered-side intake duct 56 via surge tank 20 and intake manifold 22 to various cylinders.

Also, in conjunction with the intake operation, engine 14 acts as a pressure source that generates an intake pulsation in the air in filtered-side intake duct 56, which leads to the suction noise.

Here, the intake pulsation that takes place in conjunction with the intake operation of engine 14 is a variation in pressure generated in the air present in filtered-side intake duct 56, and this pressure variation is made up of a plurality of variation in pressures at different frequencies. That is, the intake pulsation that takes place in conjunction with the intake operation of engine 14 is comprised of a plurality of intake pulsations at different frequencies. In the present embodiment, engine 14 is assumed to be a 6-cylinder in-line engine. However, the structure of engine 14 is not limited to this type.

Figure 16:
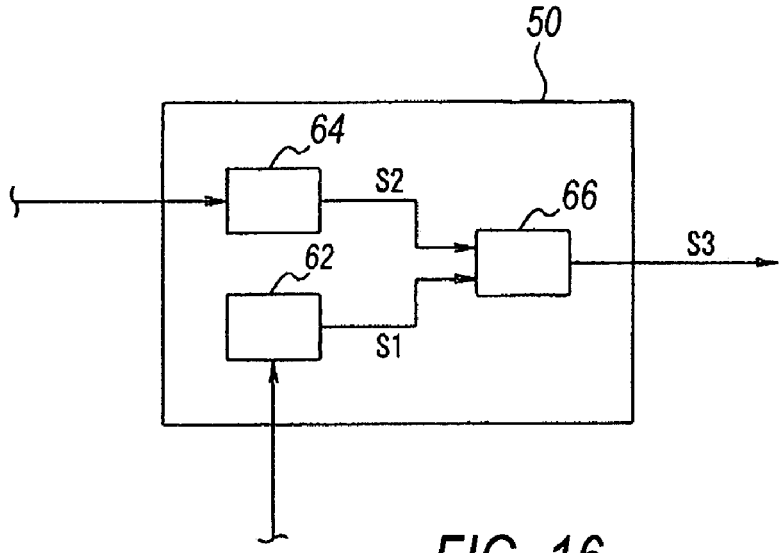
FIG. 16 is a diagram illustrating the structure of an engine control unit disposed in the amplification device of FIG. 15.

The structure of engine control unit 50 and vibration suppression mechanism 52 will now be explained. FIG. 16 is a diagram illustrating in detail the structure of engine control unit 50.

As shown in FIG. 16, engine control unit 50 includes an engine rotation information detector 62, a throttle valve openness information detector 64, and a driving state of the engine detector 66.

For example, engine rotation information detector 62 performs the following function: the engine rotation information detected by the engine rotation information sensor (not shown) attached to engine 14 is received as an engine rotation information signal S1. The received engine rotation information signal S1 is sent to driving state of the engine detector 66.

In the present embodiment, the case when the rotational velocity of engine 14 is used as the rotation information of engine 14 will be explained.

Throttle valve openness information detector 64 has the following function: the openness information of the throttle valve detected by the throttle openness sensor (not shown in the figure) attached to throttle chamber 18 is received as throttle valve openness information signal S2. The received throttle valve openness information signal S2 is sent to driving state of the engine detector 66. Also, in the present embodiment, the case when the throttle valve openness information is that the throttle valve is open will be explained.

Driving state of the engine detector 66 has the following function: it receives the engine rotation information signal S1 and the throttle valve openness information signal S2 and it computes the driving state of engine 14 on the basis of the signals. The driving state of the computed engine 14 is sent as driving state of the engine signal S3 to the vibration suppression mechanism 52.

In the following, an explanation will be given in more detail regarding the structure of vibration suppression mechanism 52 with reference to FIGS. 17 and 18.

Figure 17:
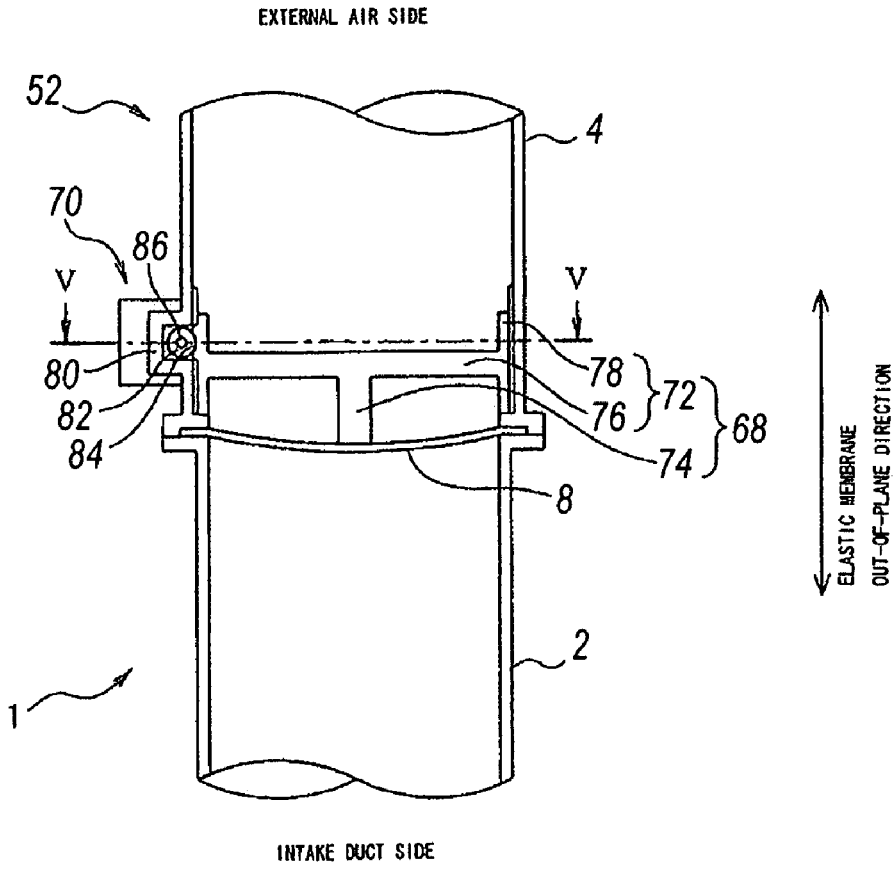
FIG. 17 is an enlarged view of the elastic membrane and a vibration suppression mechanism in encircled area A from FIG. 15.

FIG. 17 is an enlarged view illustrating the interior and its surroundings of encircled area A from FIG. 15. More specifically, FIG. 17 is a perspective view of elastic membrane member 8, vibration suppression mechanism 52 and their surroundings. FIG. 18 is a cross-sectional view taken across line V-V in FIG. 17.

Figure 18:
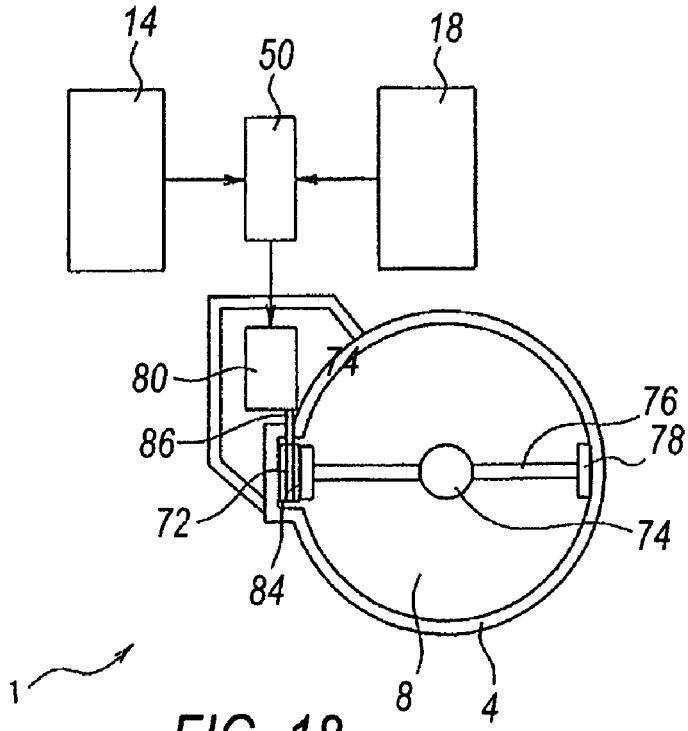
FIG. 18 is a cross-sectional view taken across line V-V in FIG. 17.

As shown in FIGS. 17 and 18, vibration suppression mechanism 52 contains a vibration suppression part 68, a vibration suppression part moving mechanism 70, and a movement distance control mechanism (not shown in the figure).

Vibration suppression part 68 comprises a base part 72 and a contact member 74. Base part 72 has main body part 76 that extends in the radial direction of additional pipe 4, and plate-shaped side plate parts 78 formed on the two ends of main body part 76, respectively. Vibration suppression part 68 is placed inside additional pipe 4 further towards the external air side than elastic membrane member 8. Rack 84 that engages a pinion 82 of a motor 80 is arranged on the surface of side plate parts 78 opposite to the inner peripheral surface of additional pipe 4.

Contact member 74 is attached at a position of elastic membrane member 8 superimposed on the central axis of additional pipe 4 as viewed in the out-of-plane direction of main body part 76, and it is arranged facing the surface of elastic membrane member 8 opposite to intake duct 12 (hereinafter referred to as "surface on the external air side").

Moving mechanism 70 of vibration suppression part 68 includes motor 80. Motor 80 contains a rotating shaft 86 and a pinion 82.

Rotating shaft 86 rotates on the basis of the movement distance computed by a movement distance control device. The computation of the movement distance by the movement distance control device will be explained below.

Pinion 82 is engaged on the rack 84 and is fixed on rotating shaft 86. Because pinion 82 is fixed on rotating shaft 86, it rotates together with rotating shaft 86. That is, in conjunction with the rotation of rotating shaft 86, pinion 82 rotates so that side plate part 78 on which 84 is arranged moves in the out-of-plane direction of elastic membrane member 8, and vibration suppression part 68 moves in the out-of-plane direction of elastic membrane member 8.

As the movement distance control device receives the driving state of the engine signal S3 from driving state of the engine detector 66, the movement distance control device computes the movement distance of vibration suppression part 68 in the out-of-plane direction of elastic membrane member 8 corresponding to the driving state of engine 14. In other words, the rotational velocity of engine 14 and the openness of the throttle valve contained in driving state of the engine signal S3 is computed. Then, on the basis of the computed movement distance, rotating shaft 86 is driven to rotate, and vibration suppression part 68 is driven to move in the out-of-plane direction of elastic membrane member 8. That is, corresponding to the driving state of engine 14, the movement distance control device controls the movement distance of vibration suppression part 68 by the vibration suppression part moving mechanism 70.

More specifically, when the rotational velocity of engine 14 and the openness of the throttle valve are below a predetermined threshold, this state is evaluated as the "non-rapid acceleration mode," so that the rotational velocity and direction of rotation of rotating shaft 86 are computed so that vibration suppression part 68 is driven to move towards the intake duct side, and on the basis of the computed rotational velocity and direction of rotation, rotating shaft 86 is driven to rotate. Also, when the rotational velocity of engine 14 and the openness of the throttle valve exceed a predetermined threshold, this state is evaluated as the "rapid acceleration mode," and the rotational velocity and direction of rotation of rotating shaft 86 are computed so that vibration suppression part 68 is driven to move towards the external air side. On the basis of the computed rotational velocity and direction of rotation, rotating shaft 86 is driven to rotate. Here, the direction of rotation of rotating shaft 86 in the rapid acceleration mode is opposite to that of rotating shaft 86 in non-rapid acceleration mode. Also, the rotational velocity of rotating shaft 86 is computed corresponding to the movement distance of vibration suppression part 68 in the out-of-plane direction of elastic membrane member 8.

In addition, the predetermined thresholds are set beforehand respectively corresponding to the non-rapid acceleration mode when the effect of amplifying the suction noise should be suppressed and to the rapid acceleration mode when the suction noise is to be amplified.

The movement distance of vibration suppression part 68 in the out-of-plane direction of elastic membrane member 8 computed by the movement distance control device will be explained below with reference to FIGS. 19 and 20.

Figure 19:
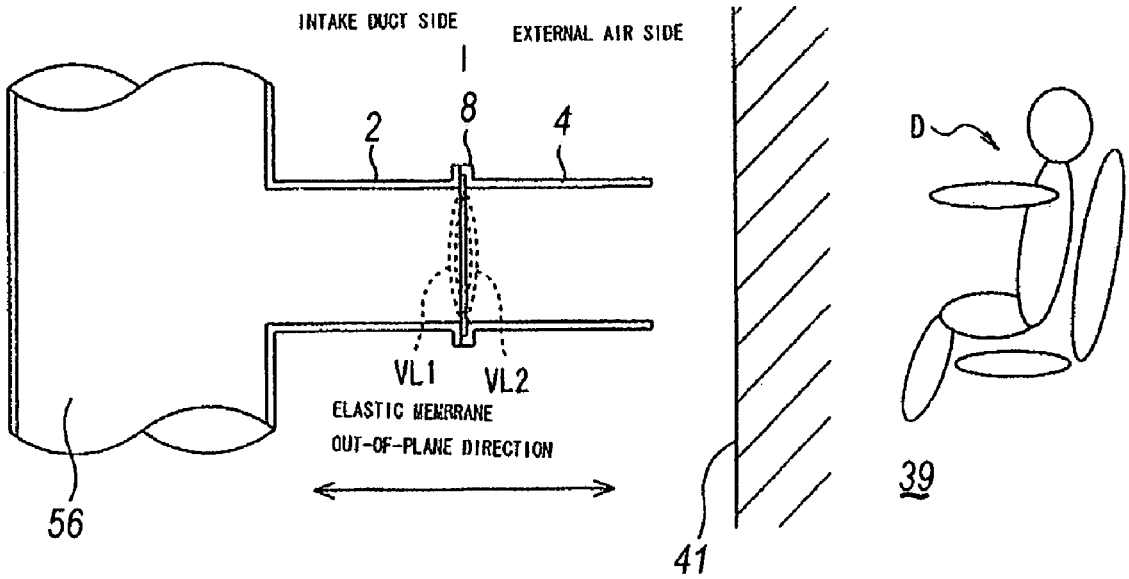
FIG. 19 is a diagram illustrating the amplification device without a vibration suppression part in a non-rapid acceleration mode.

FIG. 19 is a diagram illustrating the state in which the rotational velocity of engine 14 and the openness of the threshold valve are below the predetermined threshold in the sound amplification device 1 equipped with vibration suppression mechanism 52 of elastic membrane member 8, that is, the state of elastic membrane member 8 in the non-rapid acceleration mode. In FIG. 19, the people in vehicle passenger compartment 39 are denoted by symbol D.

As shown in FIG. 19, in an amplification device 1 without a vibration suppression mechanism of elastic membrane member 8, in the non-rapid acceleration mode, elastic membrane member 8 vibrates in the out-of-plane direction. Also, as shown in FIG. 19, the range of amplitudes of the vibrations in the out-of-plane direction of elastic membrane member 8 in the non-rapid acceleration mode is indicated by the two broken lines VL1 and VL2. Here, VL1 represents the position of maximum amplitude of the elastic deformation of elastic membrane member 8 toward the side of intake duct, and VL2 represents the position of maximum amplitude of the elastic deformation of elastic membrane member 8 toward the external air side.

Consequently, in the non-rapid acceleration mode, the movement distance control device computes the movement distance of vibration suppression part 68 in the out-of-plane direction of elastic membrane member 8 so that the position of contact member 74 facing the surface of elastic membrane member 8 on the external air side is in the position of maximum amplitude VL1 of the elastic deformation of elastic membrane member 8 towards the intake duct side (see FIG. 17). As a result, since elastic membrane member 8 is in contact with contact member 74, the vibration of elastic membrane member 14 in the out-of-plane direction can be suppressed.

Figure 20:
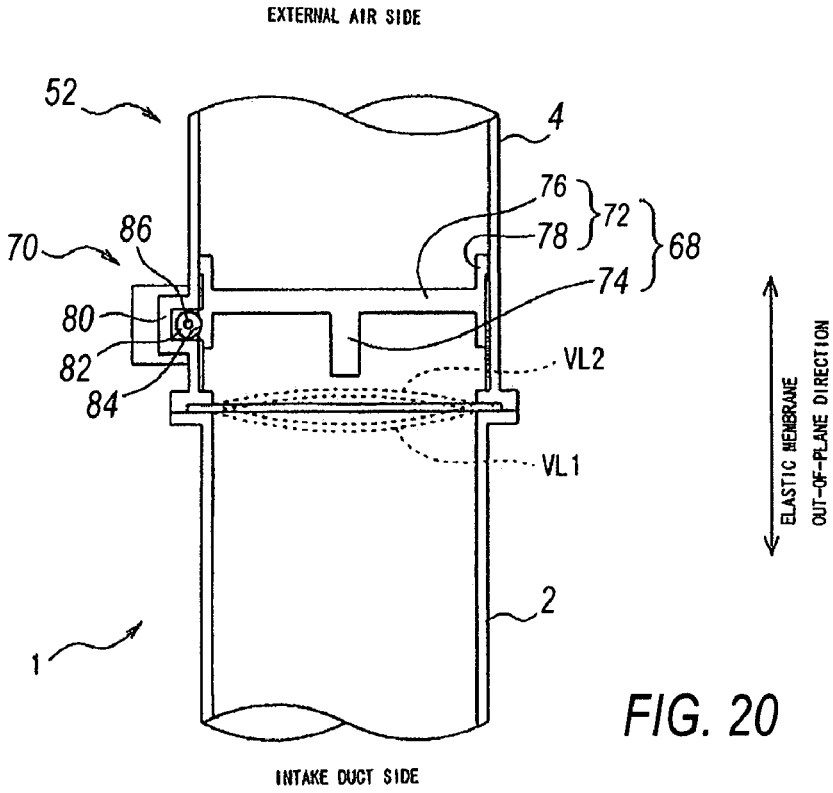
FIG. 20 is a diagram illustrating an embodiment of the elastic membrane member in the rapid acceleration mode in a ninth embodiment of the amplification device that is equipped with a vibration suppression mechanism.

FIG. 20 is a perspective view illustrating the state of amplification device 1 for amplifying suction noise that is equipped with vibration suppression mechanism 52, that is, the state of elastic membrane member 8, vibration suppression mechanism 52 and their surroundings in the state in which the rotational velocity of engine 14 and the openness of the throttle valve exceed the predetermined threshold in the ninth amplification device 1.

As shown in FIG. 20, when the position of the part of contact member 74 facing the surface of elastic membrane member 8 on the external air side is further towards the external air side than the position of maximum amplitude VL2 of the elastic deformation of elastic membrane member 8 toward the external air side, vibration suppression part 68 does not make contact with elastic membrane member 8, so that elastic membrane member 8 vibrates in the out-of-plane direction. In FIG. 20, the range of the amplitudes of vibration in the out-of-plane direction of elastic membrane member 8 in the rapid acceleration mode is indicated by the two broken lines VL1 and VL2. Here, VL1 represents the position of maximum amplitude of the elastic deformation of elastic membrane member 8 toward the side of intake duct, and VL2 represents the position of maximum amplitude of the elastic deformation of elastic membrane member 8 toward the external air side.

Consequently, by positioning the part of contact member 74 that protrudes and faces the surface of elastic membrane member 8 on the external air side further towards the external air side than the position of maximum amplitude VL2 of the elastic deformation of elastic membrane member 8 toward the external air side, it is possible for elastic membrane member 8 to vibrate freely in the out-of-plane direction in the rapid acceleration mode.

For this purpose, in the rapid acceleration mode, the movement distance control mechanism computes the movement distance of vibration suppression part 68 in the out-of-plane direction of elastic membrane member 8 so that the position of the protruding part of contact member 74 that faces the surface of elastic membrane member 8 on the external air side is located further towards the external air side than the position maximum amplitude VL2 of the elastic deformation of elastic membrane member 8 toward the external air side.

The operation of amplification device 1 for amplifying suction noise will be explained below.

As engine 14 is turned on, the intake pulsation in conjunction with the intake operation of engine 14 is propagated via intake manifold 22 and surge tank 20 into the air inside filtered-side intake duct 56 (see FIG. 15).

The intake pulsations at plural frequencies that form the intake pulsation generated in conjunction with the intake operation of engine 14 are propagated via connecting pipe 22 to elastic membrane member 8. As a result, the propagated intake pulsations at plural frequencies vibrate elastic membrane member 8 in the out-of-plane direction (see FIG. 15).

In this case, engine rotation information detector 62 receives the rotational velocity of engine 14 detected by the engine rotation information sensor as engine rotation information signal S 1, and the received engine rotation information signal S1 is sent to driving state of the engine detector 66. Also, throttle valve openness information detector 64 receives the openness of the throttle valve detected by the throttle openness sensor as throttle valve openness information signal S2. The received throttle valve openness information signal S2 is sent to driving state detector 66 of engine 14.

On the basis of engine rotation information signal S1 and throttle valve openness information signal S2, driving state detector 66 of engine 14 computes the driving state of engine 14, and the computed driving state of engine 14 is sent as driving state of the engine signal S3 to the movement distance control device equipped with vibration suppression mechanism 52.

After receiving driving state of the engine signal S3, the movement distance control device determines the driving state of engine 14 contained in driving state of the engine signal S3, and computes the movement distance of vibration suppression part 68 in the out-of-plane direction of elastic membrane member 8.

Here, in the non-rapid acceleration mode, the movement distance control device computes the movement distance of vibration suppression part 68 in the out-of-plane direction of elastic membrane member 8 so that the position of protruding part of contact member 74 facing the surface of elastic membrane member 8 on the external air side is at the position of maximum amplitude VL1 of the elastic deformation of elastic membrane member 8 towards the intake duct side.

Then, on the basis of the computed distance of vibration suppression part 68 in the out-of-plane direction of elastic membrane member 8, rotating shaft 86 is rotated, and in conjunction with the rotation of rotating shaft 86, pinion 82 is rotated. As pinion 82 is rotated in conjunction with the rotation of rotating shaft 86, side plate part 78, on which rack 84 is mounted, is driven to move towards the intake duct side, and vibration suppression part 68 is driven to move towards the intake duct side. As a result, the position of the protruding part of contact member 74 facing the surface of elastic membrane member 8 on the external air side is at the position of maximum amplitude VL1 of the elastic deformation of elastic membrane member 8 towards the intake duct side.

As a result, elastic membrane member 8 is in contact with contact member 74, and the vibration of elastic membrane member 8 in the out-of-plane direction can be suppressed. Consequently, the effect of amplifying the suction noise by amplification device 1 is suppressed (see FIG. 17).

On the other hand, in the rapid acceleration mode, the movement distance control means computes the movement distance of vibration suppression part 68 in the out-of-plane direction of elastic membrane member 8 so that the position of the protruding part of contact member 74 facing the surface of elastic membrane member 8 on the external air side is further towards the external air side than the position of maximum amplitude VL2 of the elastic deformation of elastic membrane member 8 toward the external air side.

Then, on the basis of the computed distance of vibration suppression part 68 in the out-of-plane direction of elastic membrane member 8, rotating shaft 86 is rotated, and in conjunction with the rotation of rotating shaft 86, pinion 82 rotates. As pinion 82 rotates in conjunction with the rotation of rotating shaft 86, side plate part 78 on which rack 84 is mounted is driven to move towards the external air side, and vibration suppression part 68 is driven to move towards the external air side. As a result, the position of the protruding part of contact member 74 facing the surface of elastic membrane member 8 on the external air side moves further towards the external air side than the position of maximum amplitude VL2 of the elastic deformation of elastic membrane member 8 towards the external air side.

As a result, vibration suppression part 68 will not be in contact with elastic membrane member 8, and elastic membrane member 8 can vibrate in the out-of-plane direction, so that the amplified suction noise is emitted from the opening on the other end of additional pipe 4 to the external air (see FIG. 20).

In the present embodiment, in amplification device 1, the structure of driving state detector 66 is such that it receives engine rotation information signal S1 and throttle valve openness information signal S2, and on the basis of said signals, computes the driving state of engine 14. However, the present embodiment is not limited to this scheme. For example, one may also adopt a scheme in which the structure of driving state detector 66 is such that it computes the driving state of engine 14 on the basis of engine rotation information signal S1 or throttle valve openness information signal S2. Essentially, it is only required that the structure of driving state detector 66 be such that it receives engine rotation information signal S1 and/or throttle valve openness information signal S2, and computes the driving state of engine 14 on the basis of at least one of these signals.

Also, in amplification device 1 of the present embodiment, the rotation information of engine 14 and the openness information of the throttle valve are used as the driving state of engine 14. However, the present embodiment is not limited to this scheme. For example, one may also adopt a scheme in which, e.g., the vehicle speed is used as the driving state of engine 14.

Also, in amplification device 1 of the present embodiment, the structure of the protruding part of contact member 74 is such that it is attached at the position superimposed on the central axis of additional pipe 4 as viewed in the out-of-plane direction of elastic membrane member 8 in main body part 76. However, vibration suppression part 68 is not limited to this shape. That is, the structure of the protruding part of contact member 74 may also be such that it is not attached at the position superimposed on the central axis of additional pipe 4 as viewed in the out-of-plane direction of elastic membrane member 8 in main body part 76. Essentially, the structure of the protruding part of contact member 74 should be such that it faces the surface of elastic membrane member 8 on the external air side.

In addition, in amplification device 1 of the present embodiment, amplification device 1 for amplifying suction noise is placed in engine compartment 43 in front of vehicle passenger compartment 39 in the longitudinal direction of the vehicle. However, amplification device 1 may be placed elsewhere. That is, for example, if the vehicle is designed with engine compartment 43 behind vehicle passenger compartment 39, amplification device 1 may be placed within engine compartment 43 behind vehicle passenger compartment 39 in the longitudinal direction of the vehicle. Also, for example, if the vehicle is designed with engine compartment 43 located beneath vehicle passenger compartment 39, the site for amplification device 1 may be in engine compartment 43 placed beneath vehicle passenger compartment 39. Essentially, the location in which amplification device 1 may be selected appropriately in accordance with the design of the vehicle, or more specifically, with the position of engine compartment 43.

In addition, in amplification device 1 of the present embodiment, the rotation information of engine 14 is the rotational velocity of engine 14. However, the rotation information of engine 14 is not limited to this scheme. For example, the torque of engine 14 may also be used as the rotation information of engine 14.

Also, in amplification device 1 of the present embodiment, the openness of the throttle valve is used as the openness information of the throttle valve. However, the openness information of the throttle valve is not the only operable parameter. For example, the amount of the accelerator pedal depression may also be used as the openness information of the throttle valve.

Also, in amplification device 1, vibration suppression part 68 is arranged inside additional pipe 4 and is set further towards the external air side than elastic membrane member 8. However, the position of vibration suppression part 68 is not limited to this location. That is, for example, vibration suppression part 68 may also be placed inside connecting pipe 2, and further towards the intake duct side than elastic membrane member 8. In this case, in the non-rapid acceleration mode, the movement distance control device computes the movement distance of vibration suppression part 68 in the out-of-plane direction of elastic membrane member 8 so that the protruding part of contact member 74 which faces the surface of elastic membrane member 8, is located at the position of maximum amplitude VL2 of the elastic deformation of elastic membrane member 8 toward the external air side. Also, in the rapid acceleration mode, the movement distance control device computes the movement distance of vibration suppression part 68 in the out-of-plane direction of elastic membrane member 8 so that the protruding part of contact member 74 that faces the surface of elastic membrane member 8 towards the intake duct side is located at the position of maximum amplitude VL1 of the elastic deformation of elastic membrane member 8 towards the intake duct side.

In the amplification device of the present embodiment, in the non-rapid acceleration mode when silence is to be maintained, it is possible to reduce the effect of amplifying the suction noise. On the other hand, in the rapid acceleration mode, the amplified suction noise is emitted from the opening on the other end of additional pipe 4 to the external air. As a result, it is possible both to maintain silence in the non-rapid acceleration mode and to amplify the suction noise in the rapid acceleration mode. As a result, it is possible to produce an impressive suction noise fed into vehicle passenger compartment 39 without creating an unpleasant sound for the people in the vehicle.

Also, in the amplification device of the present embodiment, the driving state of the engine detecting mechanism equipped in the engine control unit computes the driving state of engine 14 on the basis of the engine rotation information and the throttle valve openness information. Consequently, compared with the case when the driving state of engine 14 is computed on the basis of only either engine rotation information signal or the throttle valve openness information signal, it is possible to compute the driving state of engine 14 with greater precision, and it is possible to use the movement distance control device to compute the movement distance of vibration suppression part 68 in the out-of-plane direction of elastic membrane member 8 with greater precision.

Also, in the amplification device of the present embodiment, the driving state of the engine detecting mechanism equipped in the engine control unit computes the driving state of engine 14 on the basis of the engine rotation information signal and the throttle valve openness information signal. As a result, if either the engine rotation information sensor or the throttle openness sensor becomes damaged and one signal, the engine rotation information signal or the throttle valve openness information signal, is not detected, it is still possible to compute the driving state of engine 14 on the basis of the remaining information.

Consequently, the movement distance control device makes it possible to reliably compute the movement distance of vibration suppression part 68 in the out-of-plane direction of elastic membrane member 8.

Also, in the amplification device of the present embodiment, the threshold used to determine the driving state of engine 14 in the non-rapid acceleration mode or in the rapid acceleration mode can be set corresponding to the non-rapid acceleration mode when the effect of amplifying the suction noise is to be suppressed, or to the rapid acceleration mode when the suction noise is to be amplified. As a result, the suction noise can be suppressed or amplified as required, and it is possible to cope with either state, the non-rapid acceleration mode when the effect of amplifying the suction noise is to be suppressed, and the rapid acceleration mode when the suction noise is to be amplified, with different setups for different vehicles.

Embodiment 10

Figure 21:
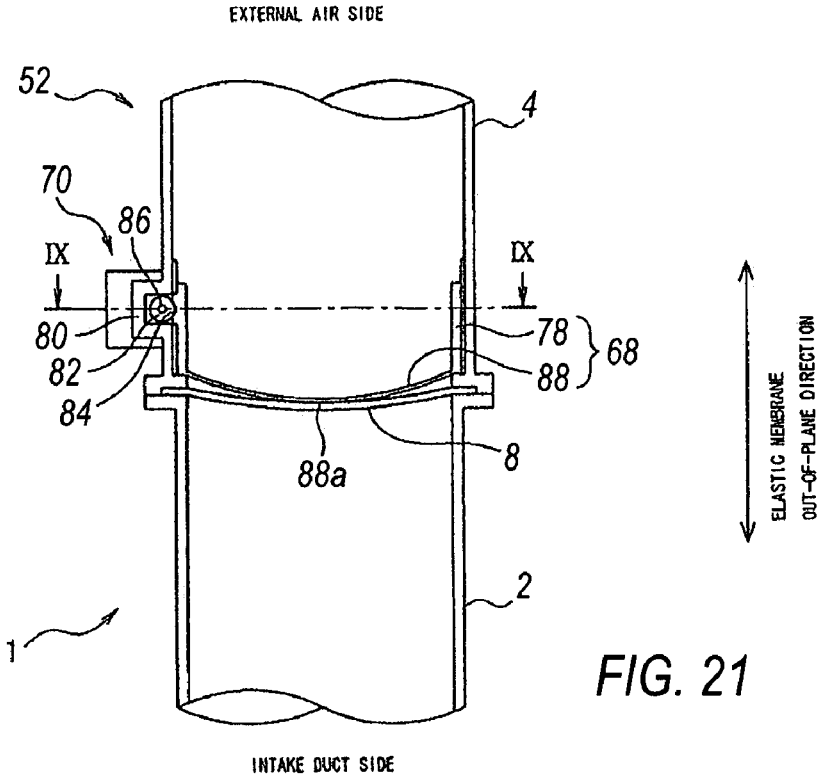
FIG. 21 is a diagram illustrating an embodiment of the elastic membrane member in the non-rapid acceleration mode in the ninth embodiment of the application device that is equipped with a vibration suppression mechanism.
Figure 22:
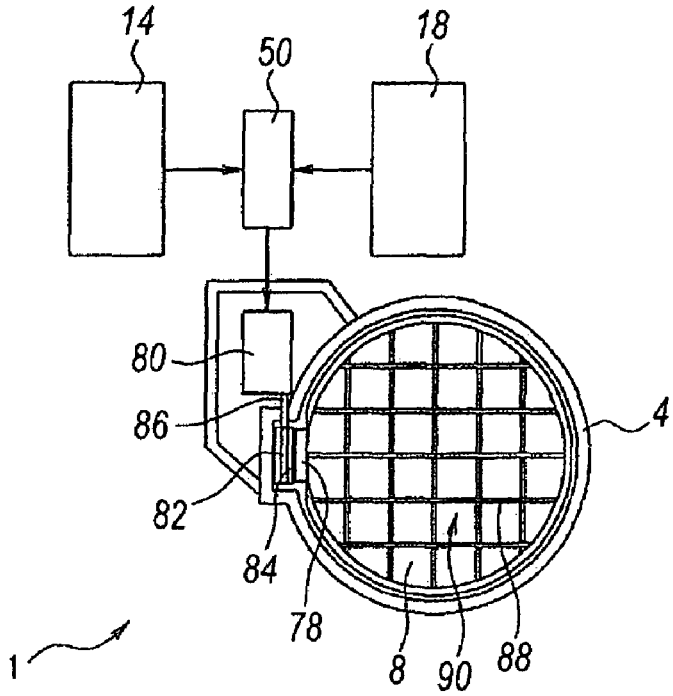
FIG. 22 is a diagram illustrating the of an amplification device in accordance with a tenth embodiment.

A tenth embodiment will now be explained. FIGS. 21 and 22 are diagrams illustrating the structure of a tenth embodiment of amplification device 1. FIG. 21 is a perspective view illustrating elastic membrane member 8, vibration suppression mechanism 52 and their surroundings. FIG. 22 is a cross-sectional view taken across line IX-IX in FIG. 21.

As shown in FIGS. 21 and 22, the structure of amplification device 1 of the tenth embodiment is generally the same as the first embodiment, except for the structure of vibration suppression part 68. That is, in the present embodiment, vibration suppression part 68 is composed of contacting part 88 and side plate part 78.

Contacting part 88 is formed from a plurality of intersecting linear elements crossing each other to form an overall grid-like shape, with a generally round shape as viewed in the out-of-plane direction of elastic membrane member 8. Also, contacting part 88 is formed in a curved arc protruding towards the side of elastic membrane member 8 as viewed from the radial direction of connecting pipe 2.

The surface of contacting part 88 that faces elastic membrane member 8 (hereinafter referred to as the surface on the intake duct side) contains a plurality of voids 90 that pass through the out-of-plane direction of elastic membrane member 8. Voids 90 appear between the plural linear elements that form contacting part 88 and comprise the non-contacting part that is not in contact with the surface of elastic membrane member 8 on the external air side.

Side plate part 78 is attached to each of two opposing locations with the central axis of additional pipe 4 sandwiched therebetween on the outer peripheral surface of contacting part 88 as seen in the out-of-plane direction of elastic membrane member 8, and it is set on the interior of additional pipe 4 and at a position further towards the external air side from elastic membrane member 8. On the surface of side plate part 78 facing the inner peripheral surface of additional pipe 4, rack 84 is set engaged with pinion 82 equipped in motor 80.

Figure 23:
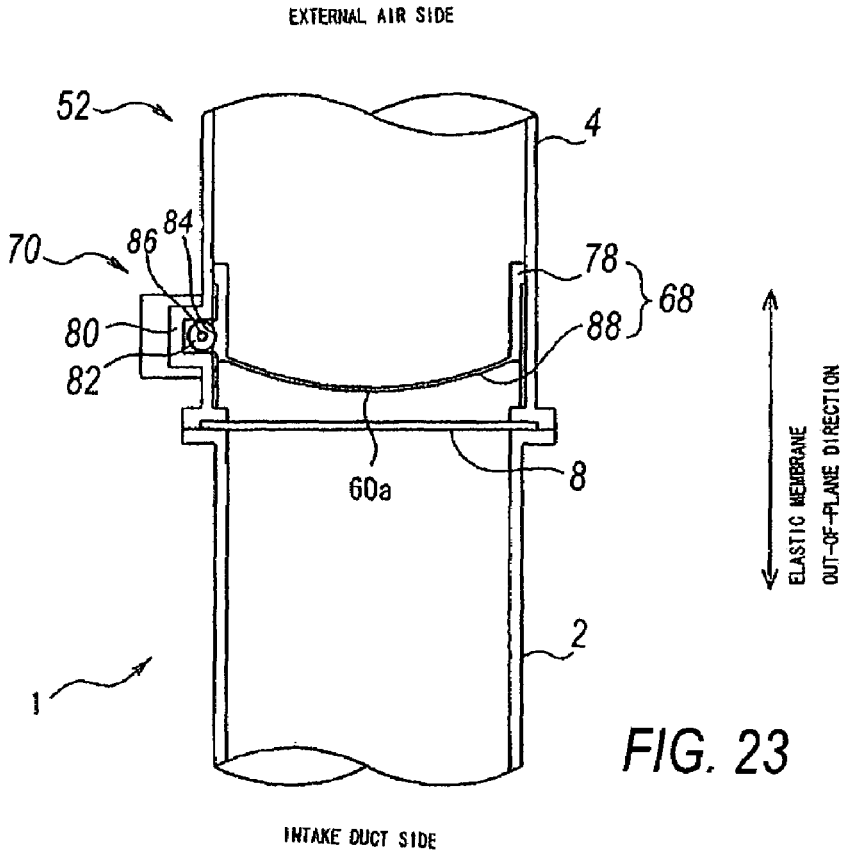
FIG. 23 is a diagram illustrating an embodiment of the elastic membrane member in the rapid acceleration mode in the tenth embodiment of the application device that is equipped with a vibration suppression mechanism.

In the following, with reference to FIGS. 21 and 23, the movement distance of vibration suppression part 68 in the out-of-plane direction of elastic membrane member 8 computed by the movement distance control device will be explained below.

As shown in FIG. 21, in the non-rapid acceleration mode, the movement distance control device computes the movement distance of vibration suppression part 68 in the out-of-plane direction of elastic membrane member 8 so that a position of part 88*a* of contacting part 88 on the side of elastic membrane member 8 is the position of maximum amplitude of elastic membrane member 8 towards the intake duct side. FIG. 23 is a perspective view illustrating elastic membrane member 8, vibration suppression mechanism 52 and their surroundings in the rapid acceleration mode. As shown in FIG. 23, in the rapid acceleration mode, the movement distance control device computes the movement distance of vibration suppression part 68 in the out-of-plane direction of elastic membrane member 8 so that the position of contacting part 88 on the side closest to elastic membrane member 8 is further towards the external air side than the elastic deformation of elastic membrane member 8 towards the external air side.

In the following, the reason that contacting part 88 is formed with a curved shape protruding to the side of elastic membrane member 8 will be explained with reference to FIGS. 24 and 25.

Figure 24:
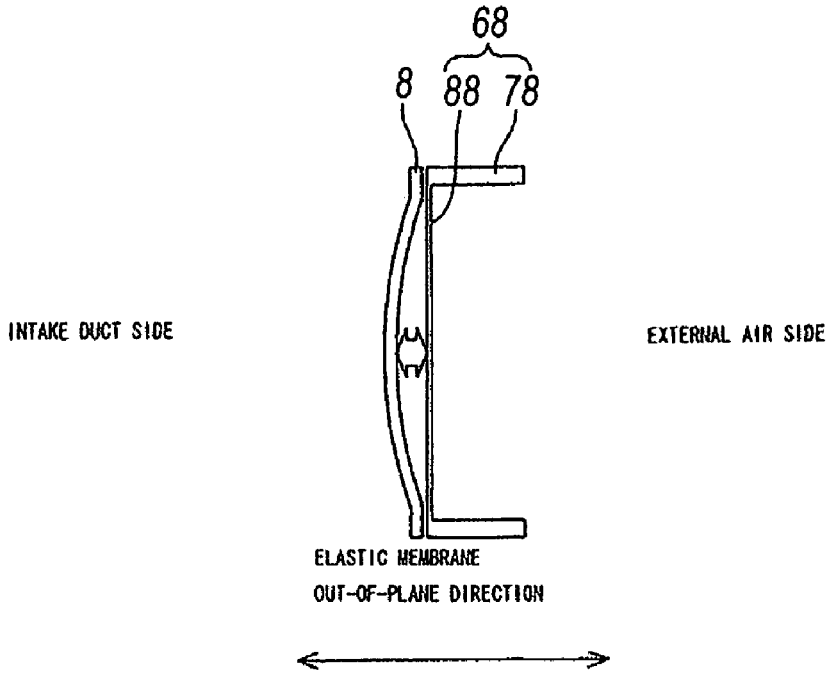
FIG. 24 is a diagram illustrating an embodiment of the application device when the vibration suppression part moves towards an intake duct side.

FIG. 24 is a diagram illustrating the case when contacting part 88 is formed in a shape that does not protrude toward the side of elastic membrane member 8, and vibration suppression part 68 moves towards the side of the intake duct. FIG. 25 is a diagram illustrating the state in which contacting part 88 is formed with a shape curved that protrudes toward the side of elastic membrane member 8, and vibration suppression part 68 moves towards the intake duct side.

As shown in FIG. 24, when contacting part 88 is formed with a shape protruding to the side of elastic membrane member 8, contacting part 88 and elastic membrane member 8 are in contact while elastic membrane member 8 is not elastically deformed in the out-of-plane direction. As a result, even when vibration suppression part 68 is driven to move to the side of intake duct 12 to make contact with elastic membrane member 8, when elastic membrane member 8 vibrates in the out-of-plane direction, although it is possible to suppress the vibration of elastic membrane member 8 towards the external air side, it is impossible to suppress the vibration of elastic membrane member 8 towards the intake duct side. Also, in FIG. 24, the range of amplitude of the vibration of elastic membrane member 8 towards the intake duct side is indicated by the bidirectional arrow.

Consequently, to suppress the vibration of elastic membrane member 8 towards the intake duct side, it is necessary to place contacting part 88 in contact with the surface of elastic membrane member 8 on the intake duct side on the surface of elastic membrane member 8 on the intake duct side.

Figure 25:
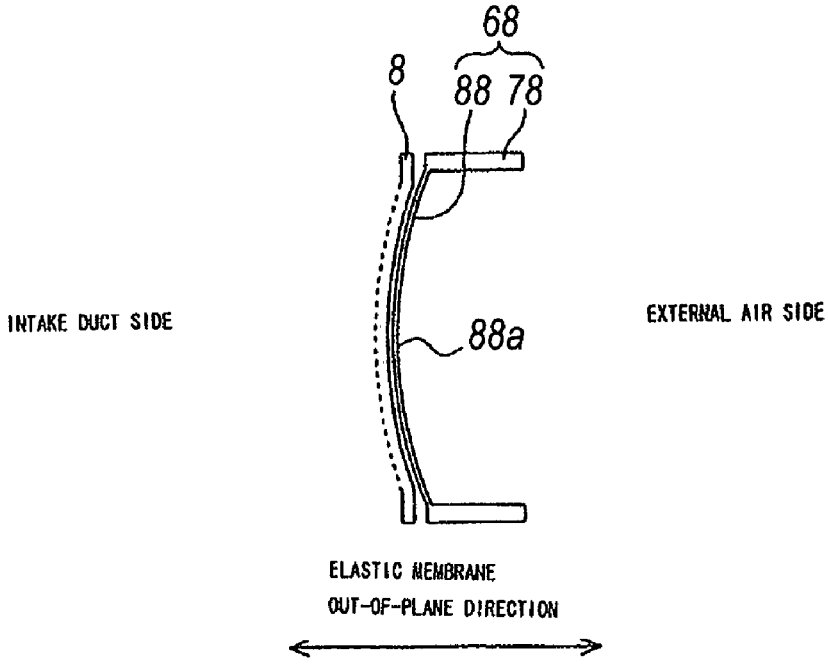
FIG. 25 is a diagram illustrating another embodiment of the application device when the vibration suppression part moves towards the intake duct side.

On the other hand, as shown in FIG. 25, when contacting part 88 is formed with a curved shape protruding towards the side of elastic membrane member 8, contacting part 88 and elastic membrane member 8 are in contact with each other while elastic membrane member 8 elastically deforms toward the intake duct side. As a result, since vibration suppression part 68 is driven to move towards the intake duct side and comes in contact with elastic membrane member 8, as elastic membrane member 8 vibrates in the out-of-plane direction, it is possible to suppress the vibration of elastic membrane member 8 towards the external air side and the intake duct side.

Consequently, since contacting part 88 is formed with a curved shape protruding towards the side of elastic membrane member 8, and vibration suppression part 68 is driven to move towards the intake duct side to make contact with elastic membrane member 8, as elastic membrane member 8 vibrates in the out-of-plane direction, it is possible to suppress the vibration of elastic membrane member 8 towards the external air side and the intake duct side.

The other features of the structure are the same as those in the first embodiment.

The operation of the present embodiment will now be explained below. In the following explanation, because the constitution is the same as that of the first embodiment, except for vibration suppression part 68, mainly the operation of those parts that differ between the embodiments will be explained.

As engine 14 is turned on, the intake pulsation in conjunction with the intake phase of engine 14 is propagated via intake manifold 22 and surge tank 20 into the air inside intake duct 12 (see FIG. 15).

The intake pulsations at plural frequencies that form the intake pulsation generated in conjunction with the intake phase of engine 14 are propagated via connecting pipe 2 to elastic membrane member 8. As a result, elastic membrane member 8 vibrates due to the propagated intake pulsation performs vibration in the out-of-plane direction of elastic membrane member 8 (see FIG. 15).

Here, in the non-rapid acceleration mode, as vibration suppression part 68 moves towards the intake duct side, contacting part 88 and elastic membrane member 8 come in contact. As a result, in the non-rapid acceleration mode, the vibration of elastic membrane member 8 in the out-of-plane direction is suppressed, and the effect of amplifying the suction noise by amplification device 1 is suppressed (see FIG. 21).

In this case, contacting part 88 is made up of a plurality of intersecting linear elements form an overall grid-like shape (see FIG. 22). As a result, in the non-rapid acceleration mode, contacting part 88 comprised of plural linear elements and elastic membrane member 8 are in contact with each other at a plurality of contact points.

On the other hand, in the rapid acceleration mode, as vibration suppression part 68 moves towards the external air side, the part of contacting part 88 facing the surface of elastic membrane member 8 on the external air side moves further towards the external air side than the position of maximum amplitude of elastic membrane member 8 towards the external air side.

As a result, vibration suppression part 68 does not make contact with elastic membrane member 8, and elastic membrane member 8 vibrates in the out-of-plane direction.

In this case, between the plural linear elements that form contacting part 88, there are a plurality of voids 90 that pass through the out-of-plane direction of elastic membrane member 8, which forms the non-contacting part (see FIG. 22).

As a result, in the rapid acceleration mode, elastic membrane member 8 is vibrated in the out-of-plane direction. During to the vibration, pulsating air passes through the various voids into additional pipe 4, and the amplified suction noise is emitted from the second opening of additional pipe 4 to the external air (see FIG. 23).

In the device for amplifying suction noise of the present embodiment, the contact member included in the vibration suppression part is formed from a plurality of linear elements crossing each other to form an overall grid-like shape. Also, the contacting part forms a curved arc shape that protrudes towards the intake duct side.

Consequently, in the non-rapid acceleration mode, the contacting part comprised of a plurality of linear elements and the elastic membrane member are in contact at many contact points, and the area of the part of the elastic membrane member that vibrates in the axial direction of the connecting pipe is reduced.

As a result, compared with the aforementioned case in which the contacting part and the elastic membrane member are in contact with each other only at one contact point in the amplification device of the first embodiment, in this embodiment, it is possible to further suppress the vibration of the elastic membrane member, and it is possible to further reduce the effect of amplifying the suction noise.

Also, in the amplification device in the present embodiment, the contacting part of the vibration suppression part is formed from a plurality linear elements crossing each other to form an overall grid-like shape. As a result, in the non-rapid acceleration mode, the points of contact between said contact part and the elastic membrane member are formed uniformly over the entire surface of the elastic membrane member on the external air side.

Consequently, it is possible to realize a state of stable contact between the contacting part and the elastic membrane member, and reliably to suppress the vibration of the elastic membrane member. Consequently, it is possible to reduce the effect of amplifying the suction noise reliably.

Also, in the amplification device of the tenth embodiment, the contacting part of the vibration suppression part is formed from a plurality of linear elements crossing each other. As a result, in the non-rapid acceleration mode, there are a plurality of contact points between said contacting part composed of a plurality linear elements and the elastic membrane member.

Consequently, compared with the aforementioned case in which the contacting part and the elastic membrane member are in contact with each other at only one contact point in the device for amplifying suction noise described in the first embodiment, in the this embodiment, it is possible to further reduce damage to the elastic membrane member. As a result, it is possible to further improve the durability of the elastic membrane member.

Embodiment 11

Figure 26:
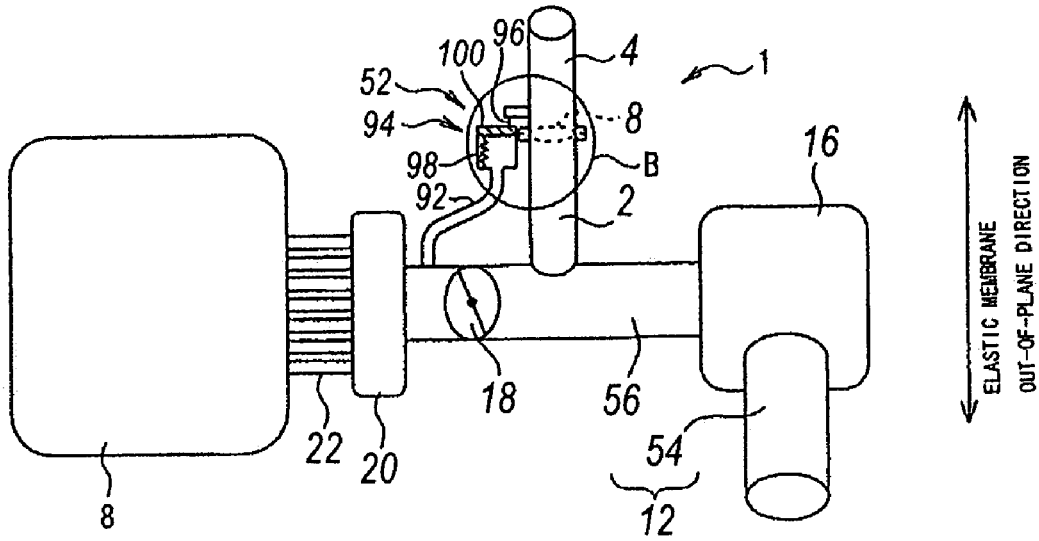
FIG. 26 is a diagram illustrating the top view of an engine compartment equipped with an embodiment of the amplification device.

An eleventh embodiment will now be explained. FIG. 26 is a diagram illustrating the structure of amplification device 1 according to the eleventh embodiment.

As shown in FIG. 26, amplification device of the present embodiment includes connecting pipe 2, additional pipe 4, elastic membrane member 8 and vibration suppression mechanism 52. Here, the structure in the present embodiment is generally the same as that of the first embodiment, except for the structure of vibration suppression mechanism 52. Consequently, the explanation of the same structures as that in the first embodiment will not be repeated.

Here, vibration suppression mechanism 52 containing vibration suppression part 68 and vibration suppression part moving mechanism 70.

The structure of vibration suppression part 68 will be explained further below. Vibration suppression part moving mechanism 70 has a draft tube 92 and a cylinder 94. For example, draft tube 92 may consist of a rubber hose or another flexible cylindrically shaped element. The opening on one end of draft tube 92 is attached and connected to filtered-side intake duct 56 on the part between surge tank 20 and throttle chamber 18 on the outer peripheral surface of filtered-side intake duct 56. The opening on the other end of draft tube 92 is connected to the interior of cylinder 94.

Cylinder 94 is formed as a generally cylindrical element. A first opening at one end is connected to a first opening on the other end of draft tube 92. Connecting member 96 protrudes from a second opening on the other end. Details of cylinder 94 will be explained below.

The relationship between the intake vacuum and the throttle openness for the part between surge tank 20 and throttle chamber 18 in filtered-side intake duct 56 will be explained below.

In the non-rapid acceleration mode, the amount of the accelerator pedal depression is reduced, that is, the throttle openness is less, and the intake rate decreases. As a result, the intake vacuum in the part between air cleaner 16 and throttle chamber 18 decreases, and at the same time, the intake vacuum of the part between surge tank 20 and throttle chamber 1850 increases.

On the other hand, in the rapid acceleration mode, the amount of the accelerator pedal depression is increased, that is, the throttle openness is greater, and the intake rate becomes higher. As a result, the intake vacuum in the part between air cleaner 16 and throttle chamber 18 increases, and at the same time, the intake vacuum in the part between surge tank 20 and throttle chamber 18 is less.

This occurs for the following reason: corresponding to the variation in the throttle openness, the area of the flow channel for the air moving from the part between air cleaner 16 and throttle chamber 18 to the part between surge tank 20 and throttle chamber 18 varies inside filtered-side intake duct 56. More specifically, in the non-rapid acceleration mode, that is, when the area of flow channel is smaller, the intake vacuum generated in the air passing through throttle chamber 18 is reduced. On the other hand, in the rapid acceleration mode, that is, when the area of the flow channel is larger, the intake vacuum generated in the air passing through throttle chamber 18 is higher.

Figure 27:
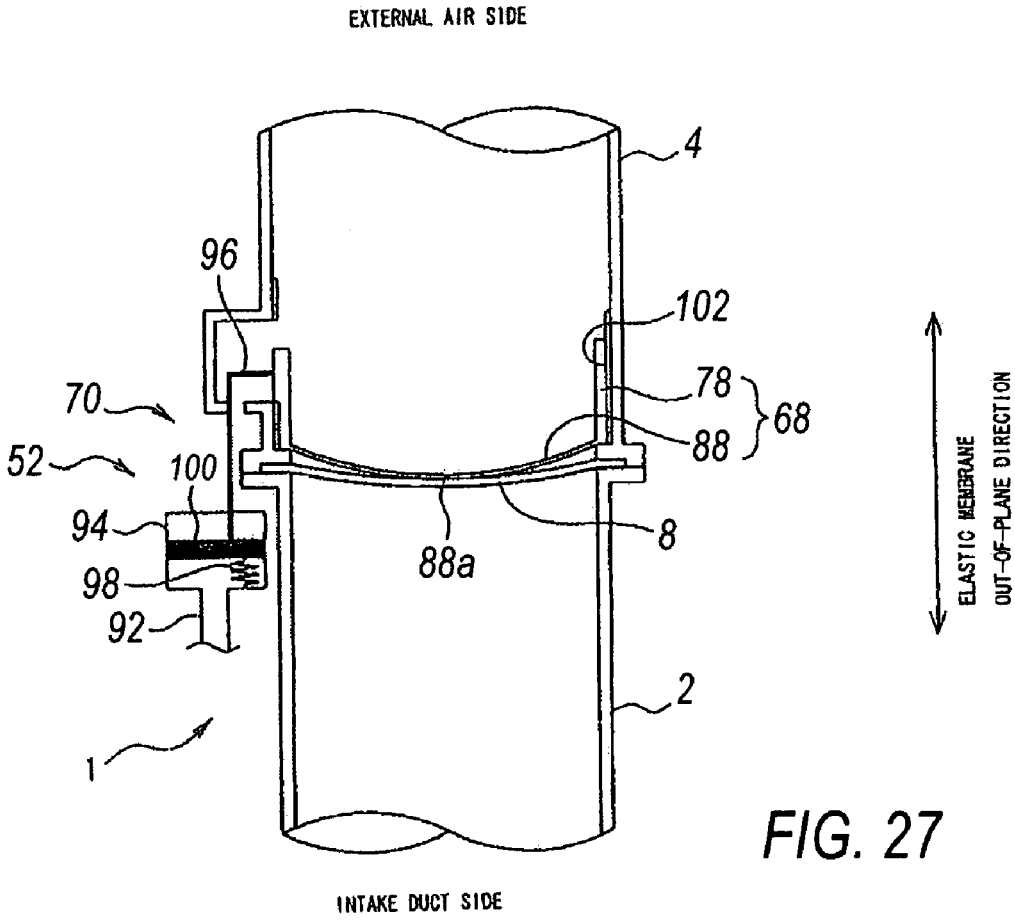
FIG. 27 is a diagram illustrating the structure of the eleventh embodiment of the amplification device.

FIG. 27 is an enlarged view of the interior of the encircled area B and its surroundings. It is a perspective view illustrating elastic membrane member 8 and vibration suppression mechanism 52 as well as their surroundings in the non-rapid acceleration mode.

As shown in FIG. 27, cylinder 94 contains an elastic member 98 and a lid member 100. For example, elastic member 98 comprises a coil spring placed inside cylinder 94 so that it can stretch freely in the out-of-plane direction of elastic membrane member 8. The end on one side of elastic member 98 is attached to the inner wall surface inside the cylinder on the side of draft tube 92, and the end on the other side of elastic member 98 is attached to the surface of lid member 100 on the side of draft tube 92.

Lid member 100 blocks the interior of cylinder 94, as viewed in the out-of-plane direction of elastic membrane member 8, and moves in the out-of-plane direction of elastic membrane member 8 in conjunction with the stretching of elastic member 98. Connecting member 96 is attached to the surface of lid member 100 opposite to the side of draft tube 92.

Connecting member 96 is an approximately L-shaped rod. The end on one side is attached to the surface of lid member 100 opposite to the side of draft tube 92, and the end on the other side is attached to the surface of side plate part 78 opposite to the inner peripheral surface of additional pipe 4.

Vibration suppression part 68 includes contacting part 88 and side plate part 78. Since the structure of contacting part 88 is generally the same as that in the second embodiment, it will not be explained in detail again. Side plate part 78 is attached at each of two locations that face each other with the central axis of additional pipe 4 sandwiched therebetween on the outer peripheral surface of contacting part 88, as seen in the out-of-plane direction of elastic membrane member 8, and is fitted so that it can move in the out-of-plane direction of elastic membrane member 8 with respect to a rail part 102 set on the inner peripheral surface of additional pipe 4. Also, side plate part 78 is set inside additional pipe 4 at a position further towards the external air side than elastic membrane member 8. The second end of connecting member 96 is attached to the surface of side plate part 78 facing the inner peripheral surface of additional pipe 4.

In the following, the spring coefficient of elastic member 98 in the out-of-plane direction of elastic membrane member 8 will be explained with reference to FIGS. 27 and 28.

As shown in FIG. 27, the spring coefficient of elastic member 98 in the out-of-plane direction of elastic membrane member 8 refers to the amount of contraction of elastic member 98 in the non-rapid acceleration mode when the intake vacuum in the part between surge tank 20 and throttle chamber 18 rises and the higher intake vacuum passes through draft tube 92 inside cylinder 94. Here, the spring coefficient of elastic member 98 in the out-of-plane direction of elastic membrane member 8 is set to an appropriate value so that in the non-rapid acceleration mode, as elastic member 98 contracts, part 88*a* of contacting part 88 closest the side of elastic membrane member 8 is at the position of the maximum amplitude position of elastic membrane member 8 towards the side of intake duct 12.

Figure 28:
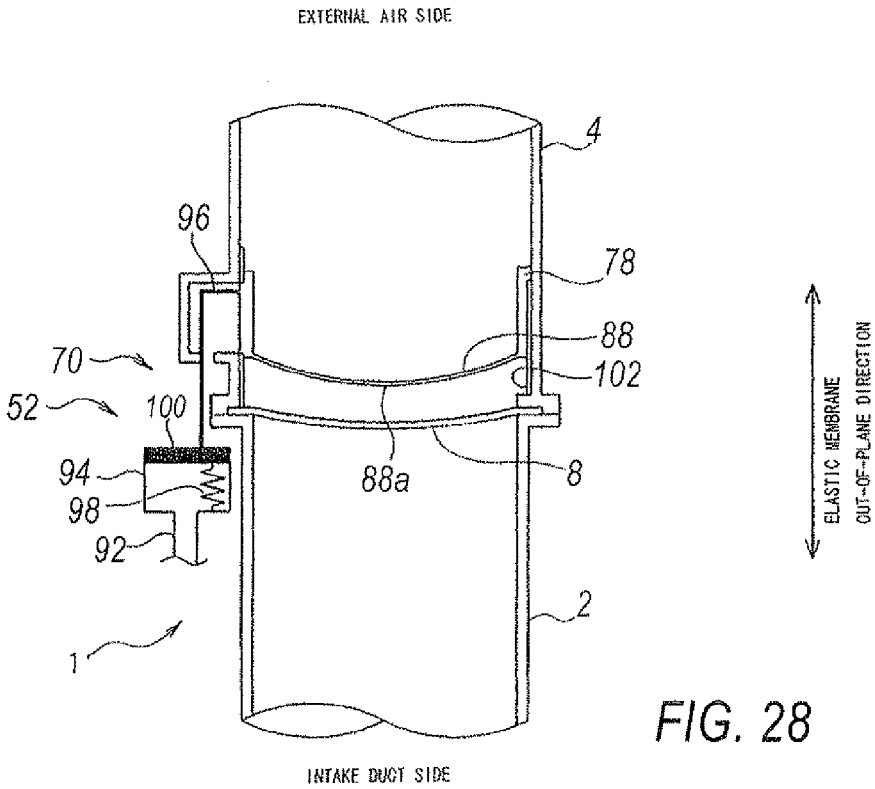
FIG. 28 is a diagram illustrating the elastic membrane member in the rapid acceleration mode in the eleventh embodiment of the amplification device that is equipped with a vibration suppression mechanism.

FIG. 28 is a perspective view illustrating elastic membrane member 8, vibration suppression mechanism 52 and their surroundings in the rapid acceleration mode.

As shown in FIG. 28, in the rapid acceleration mode, the spring coefficient of elastic member 98 in the out-of-plane direction of elastic membrane member 8: in the rapid acceleration mode, the intake vacuum in the part between surge tank 20 and throttle chamber 18 is reduced, and the increased intake vacuum passes inside cylinder 94 through draft tube 92, and, in this case, elastic member 98 stretches. On the other hand, the spring coefficient of elastic member 98 in the out-of-plane direction of elastic membrane member 8 is selected appropriately so that in the rapid acceleration mode, as elastic member 98 is stretched, part 88*a* of contacting part 88 side of elastic membrane member 8 is in a position further towards the external air side than the maximum amplitude position of elastic membrane member 8 towards the external air side.

Consequently, the spring coefficient of elastic member 98 in the out-of-plane direction of elastic membrane member 8 is selected to have an appropriate value that ensures that vibration suppression part 68 is driven to move in the out-of-plane direction of elastic membrane member 8 due to the intake vacuum generated in the part between surge tank 20 and throttle chamber 18 inside filtered-side intake duct 56.

That is, vibration suppression part's moving mechanism 70 in the present embodiment is constructed so that vibration suppression part 68 is driven to move in the out-of-plane direction of elastic membrane member 8 due to the intake vacuum generated in the part between surge tank 20 and throttle chamber 18 inside filtered-side intake duct 56.

Also, elastic member 98 acts as a movement distance control device that controls the movement distance of vibration suppression part 68 by vibration suppression part moving mechanism 70 corresponding to the driving state of engine 14.

Also, the spring coefficient of elastic member 98 in the out-of-plane direction of elastic membrane member 8 is preset corresponding to the non-rapid acceleration mode when the effect of amplifying the suction noise should be suppressed and in the rapid acceleration mode when the suction noise should be amplified.

The other features of the structure of the eleventh embodiment are generally the same as those of the ninth embodiment.

The operation of the present embodiment will be explained below. In the following, since the structure is generally the same as that of the ninth embodiment, except for vibration suppression mechanism 52, mainly just the operation of those portions that differ between the embodiments will be explained (see FIG. 26).

As engine 14 is turned on, the intake pulsation in conjunction with the intake operation of engine 14 is propagated via intake manifold 22 and surge tank 20 into the air inside filtered-side intake duct 56 (see FIG. 26).

The intake pulsations at plural frequencies that form the intake pulsation generated in conjunction with the intake operation of engine 14 are propagated via connecting pipe 2 to elastic membrane member 8. As a result, elastic membrane member 8 vibrates in the out-of-plane direction of elastic membrane member 8 due to the propagated intake pulsation (see FIG. 26).

Here, in the non-rapid acceleration mode, as the intake vacuum in the part between surge tank 20 and throttle chamber 18 is increased, the increased intake vacuum passes through draft tube 92 and elastic member 98 contracts.

As elastic member 98 contracts, lid member 100 moves towards the side of draft tube 92, connecting member 96 moves towards the side of draft tube 92, and side plate part 78 moves toward the intake duct side, so that vibration suppression part 68 moves towards the intake duct side.

In this case, the spring coefficient of elastic member 98 in the out-of-plane direction of elastic membrane member 8 is set to an appropriate value so that in the non-rapid acceleration mode, as elastic member 98 contracts, part 88*a* of contacting part 88 side of elastic membrane member 8 is in the position of the maximum amplitude of elastic membrane member 8 towards the intake duct side.

Consequently, as vibration suppression part 68 moves towards the intake duct side, elastic membrane member 8 elastically deforms towards the intake duct side, and elastic membrane member 8 is in the position of maximum amplitude of elastic membrane member 8 towards the intake duct side.

Since the position of elastic membrane member 8 is in the position of maximum amplitude of elastic membrane member 8 towards the intake duct side, the vibration of elastic membrane member 8 in the out-of-plane direction in the non-rapid acceleration mode is suppressed, so that the effect of amplifying the suction noise by device 1 for amplifying suction noise is suppressed (FIG. 27).

On the other hand, in the rapid acceleration mode, as the intake vacuum in the part between surge tank 20 and throttle chamber 18 is decreased, the decreased intake vacuum passes through draft tube 92 and elastic member 98 is stretched.

As elastic member 98 is stretched, lid member 100 is driven to move to the side opposite to draft tube 92, connecting member 96 is driven to move to the side opposite to draft tube 92, and side plate part 78 is driven to move toward the external air side, so that vibration suppression part 68 moves toward the external air side.

In this case, the spring coefficient of elastic member 98 in the out-of-plane direction of elastic membrane member 8 is set to an appropriate value so that in the rapid acceleration mode, as elastic member 98 is stretched, part 88*a* of contacting part 88 side of elastic membrane member 8 is in a position further towards the external air side than the position of maximum amplitude of elastic membrane member 8 towards the external air side.

Consequently, when vibration suppression part 68 moves towards the external air side, the part of contacting part 88 facing the surface of elastic membrane member 8 on the external air side is further towards the external air side than the position of maximum amplitude of elastic membrane member 8 towards the external air side.

Consequently, since vibration suppression part 68 is not in contact with elastic membrane member 8, which vibrates in the out-of-plane direction of elastic membrane member 8 in the rapid acceleration mode, elastic membrane member 8 vibrates in the out-of-plane direction, the vibration of the air due to said vibration passes through the various voids into additional pipe 4, and the amplified suction noise is emitted from the second opening of additional pipe 4 to the external air (see FIG. 28).

Amplification device 1 of the present embodiment differs from amplification device 1 of the ninth and tenth embodiments in that it does not have the engine control unit and motor. However, the structure of amplification device is not so limited. That is, the structure of amplification device may have the following structure in addition to the structure of amplification device of the present embodiment. That is, a structure with an engine control unit and a motor in which vibration suppression part 68 is driven to move in the out-of-plane direction of elastic membrane member 8 corresponding to the intake vacuum generated in the part between surge tank 20 and throttle chamber 18 as well as the engine rotation information and the throttle valve openness information in filtered-side intake duct 56 may be included.

For amplification device 1 of the present embodiment, draft tube 92 may be comprised of a rubber hose or another flexible cylindrical member. However, the present embodiment is not limited to this scheme. For example, draft tube 92 may also be formed as a combination of curved or bent cylindrical members with high rigidity. Essentially, draft tube 92 should have a structure in which the intake vacuum in the part between surge tank 20 and throttle chamber 18 is applied to the interior of cylinder 94.

In the amplification device 1 of the present embodiment, due to the intake vacuum generated in the part between the surge tank and the throttle chamber inside filtered-side intake duct, the vibration suppression part is driven to move in the out-of-plane direction of the elastic membrane member. That is, instead of the driving state of the engine, the change in the intake vacuum generated in the part between the surge tank and the throttle chamber in the filtered-side intake duct is used to move the vibration suppression part in the out-of-plane direction of elastic membrane member 8.

Consequently, unlike the ninth and tenth embodiments, in the present embodiment, there is no need to use various types of sensors and engine control units, etc. to ensure that in the non-rapid acceleration mode when silence is to be maintained, it is possible to reduce the effect of amplifying the suction noise, while in the rapid acceleration mode, the amplified suction noise is emitted from the second opening of additional pipe 4 to the external air.

As a result, with a simple constitution, it is possible both to maintain silence in the non-rapid acceleration mode and to amplify the suction noise in the rapid acceleration mode. As a result, it is possible to reduce the manufacturing costs of the amplification device.

In addition, in the amplification device of the present embodiment, the spring coefficient for the elastic deformation in the axial direction of the connecting pipe can be set corresponding to the non-rapid acceleration mode when the effect of amplifying the suction noise should be suppressed and the rapid acceleration mode when the suction noise should be amplified. Consequently, the suction noise can be either suppressed or amplified, and it is possible to cope with either state of the vehicle by using different settings for different vehicles with respect to the non-rapid acceleration mode when the effect of amplifying the suction noise should be suppressed and the rapid acceleration mode when the suction noise should be amplified.

In the ninth, tenth, and eleventh embodiments, the movement distance control mechanism controls the movement distance of the vibration suppression part by the vibration suppression part moving mechanism corresponding to the driving state of the engine. However, one may also adopt a scheme in which the movement distance of the vibration suppression part is controlled corresponding to the operation of switches, etc. set in the vehicle passenger compartment when the driver desires silence.

Figure 29:
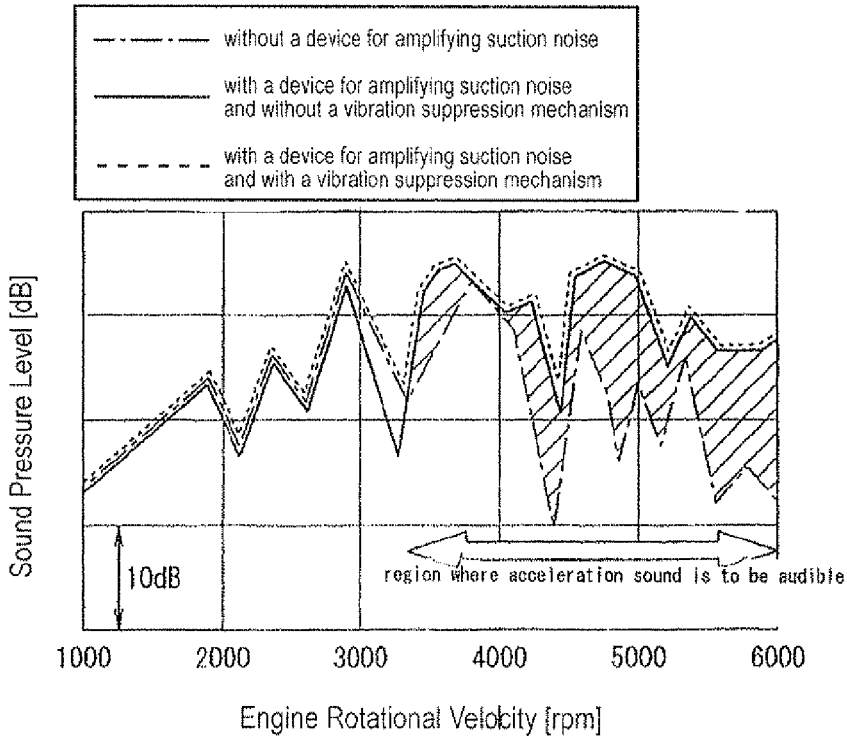
FIG. 29 is a diagram illustrating measurement results of a sound pressure level of suction noise fed into a vehicle passenger compartment during acceleration.
Figure 30:
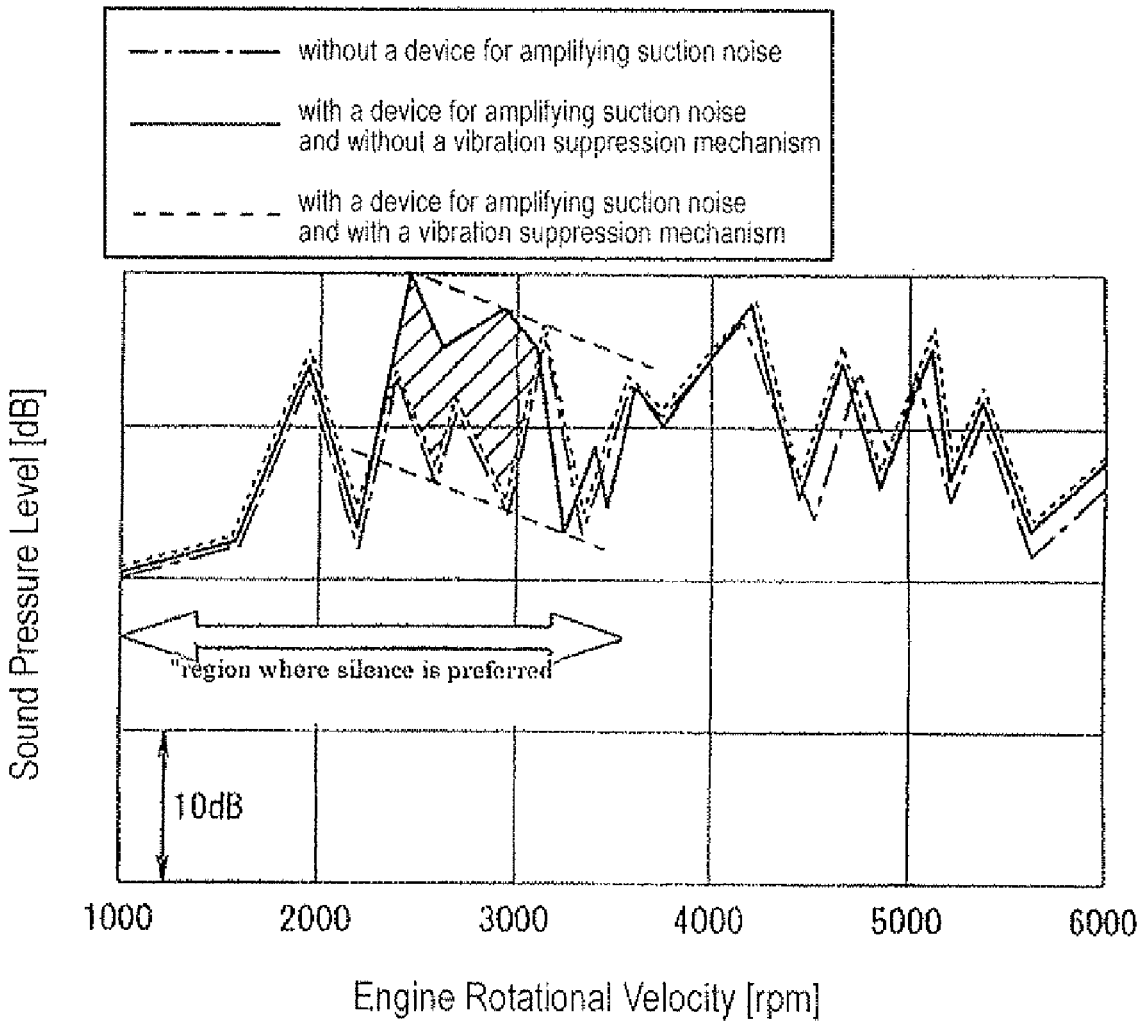
FIG. 30 is another diagram illustrating measurement results of the sound pressure level of suction noise fed into the vehicle passenger compartment during acceleration.

FIG. 29 and FIG. 30 respectively show the measurement results of the sound pressure level of the suction noise fed into the vehicle cabin, especially to the driver's seat, in the case of acceleration of a vehicle equipped with the amplification device of the present invention and of a vehicle equipped with a conventional sound pressure amplification device. In FIG. 29 and FIG. 30, the ordinate represents the sound pressure level of the suction noise fed into the vehicle passenger compartment (described as "sound pressure level" in the figures), and each scale division represents 10 dB. On the other hand, in FIGS. 29 and FIG. 30, the abscissa represents the rotational velocity of the engine (labeled "engine rotational velocity" in the figures) during acceleration, with each scale division representing 1000 rpm.

As the amplification device in the example shown, as shown in FIG. 18, an amplification device having the same structure as that explained in the ninth embodiment is used. Also, as the threshold used to distinguish between the non-rapid acceleration mode and the rapid acceleration mode is the engine rotational velocity; 3,500 rpm is used as a threshold parameter.

A sound pressure amplification device of the related art is shown in FIG. 19. In this sound pressure application device, there is no vibration suppression mechanism provided.

The measurement results of the sound pressure level of the suction noise fed into the vehicle passenger compartment during acceleration will be explained below. In FIGS. 29 and 30, the measured sound pressure level of a vehicle equipped with the amplification device of the present disclosure is indicated by the broken line; the measured sound pressure level for a vehicle equipped with the sound pressure application device of the related art is represented by the solid line; and the measured sound pressure level of the vehicle without a sound pressure application device is represented by a dot-dash line. In FIG. 29, of the plural frequency components that make up the suction noise, only the sound of the engine fundamental order number X n component is shown. In FIG. 30, of the plural frequency components that make up the suction noise, only the sound of the engine's fundamental order number 14×2n component is shown.

As shown in FIGS. 29 and 30, unlike the vehicle without the sound pressure application device, the vehicle equipped with the sound pressure application device of the related art has the following feature: in the high rotational velocity region, where the engine rotational velocity is about 3,500 rpm or higher (the region indicated by bidirectional arrow and described as "region where acceleration sound is to be audible" in FIG. 29), that is, in the rapid acceleration mode, the suction noise or acceleration sound is amplified. However, in the low rotational velocity region, where the engine's rotational velocity is about 3,500 or lower (the region indicated by bidirectional arrow and described as "region where silence is preferred"), that is, in the non-rapid acceleration mode, the suction noise or acceleration sound is also amplified. As a result, it is difficult to ensure silence. Also, in FIGS. 29 and 30, the region where the suction noise is amplified is indicated by the hatched part.

On the other hand, in the vehicle equipped with the amplification device of the present disclosure in the rapid acceleration mode, like the vehicle equipped with the sound pressure application device of the related art, the suction noise or acceleration sound is amplified. On the other hand, in the non-rapid acceleration mode, the sound pressure level is similar to that of the vehicle without the sound pressure application device, and the sound pressure level is lower than that of the vehicle equipped with the sound pressure application device of the related art by about 12 dB, that is, quietness is improved.

From the aforementioned measurement results, it can be seen that, the effect of amplifying the suction noise is displayed in the vehicle equipped with the amplification device of the present disclosure, in the rapid acceleration mode. On the other hand, in the non-rapid acceleration mode, such as during constant-speed travel, etc., it is possible to improve the quietness relative to that of the vehicle equipped with the sound pressure application device of the related art.

The preceding description has been presented only to illustrate and describe exemplary embodiments of the oil return device according to the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method for amplifying the suction noise of a vehicle, comprising:

vibrating an elastic membrane in response to variation in pressure of air fed into an engine inlet port, and contacting the membrane to suppress the vibration of the elastic membrane in response to an acceleration state of the vehicle.

2. The method of amplifying the suction noise of a vehicle described in claim 1, wherein during the step of suppressing vibration, when the acceleration of the vehicle is lower than a predetermined threshold, an amplitude of the vibration of said elastic membrane is smaller than that when the acceleration of the vehicle is higher than the predetermined threshold.

3. The method for amplifying the suction noise of a vehicle described in claim 1, wherein during the step of suppressing vibration, the acceleration state of the vehicle is determined on the basis of a pressure level of air fed into the engine inlet port.

4. The method for amplifying the suction noise of a vehicle described in claim 1, wherein during the step of suppressing vibration, the acceleration state of the vehicle is determined on the basis of at least one of an engine rotational velocity and the openness of a throttle valve that adjusts the air flow rate fed into the engine inlet port.

5. An amplification device for amplifying suction noise of a vehicle, comprising:

an intake duct for feeding air into an engine inlet port, a connecting pipe connected to an interior of the intake duct, an elastic membrane member that blocks a passageway inside of the connecting pipe, and a contact member that is connected to the connecting pipe and includes at least one portion that is adapted to selectively contact a surface of the elastic membrane member that faces the intake duct.

6. The amplification device described in claim 5, wherein:

the contact member comprises a plurality of contact portions that are adapted to contact a surface of the elastic membrane member that faces the intake duct, wherein the plurality of contact portions are positioned such that the contact portions contact the surface of the elastic membrane between a center of the elastic membrane member and a rim of the elastic membrane member.

7. The amplification device described in claim 5, wherein:

the elastic membrane member is generally circular or elliptical in shape, and the portion of the contact member that contacts the elastic membrane member contacts at least a center of the elastic membrane member.

8. The amplification device described in claim 5, further comprising:

a buffer member that is operatively engaged with the portion of the contact member that contacts the elastic membrane member.

9. The amplification device described in claim 5, wherein:

the contact member is the contact surface that is in contact with the elastic membrane member.

10. The amplification device described in claim 9, wherein:

the contact surface further comprises at least one through-hole.

11. The amplification device described in claim 9, wherein:

the surface of the contact member is formed with a generally convex shape that projects towards the elastic membrane member side when viewed in a radial direction of the connecting pipe.

12. The amplification device described in claim 5, wherein:

the elastic membrane member is supported on the connecting pipe via a vibration membrane support member that is constructed of an elastic member having greater rigidity in an axial direction of the connecting pipe than that of the elastic membrane member.

13. The amplification device described in claim 5, wherein:

the contact member is connected to the connecting pipe at a position where the elastic membrane member is elastically deformed toward an intake duct side.

14. The amplification device described in claim 13, wherein:

the contact member has a contact surface that is in contact with the elastic membrane member.

15. The amplification device described in claim 14 wherein:

the contact surface contains at least one through-hole.

16. The amplification device described in claim 5, further comprising:

a rack that is supported on the contact member and that extends in a direction crossing a plane of the elastic membrane member, a motor that is supported on the connecting pipe and that contains a rotating shaft, a pinion that is fixed on the rotating shaft and selectively engages with the rack, and a switch connected to the motor.

17. The amplification device described in claim 5, further comprising:

the contact member extending in the direction crossing the plane of said elastic membrane member, a shaft member that is fixed on the contact member and extends in the direction crossing the contact member, a rotating shaft connected to the shaft member, a motor that generates a driving force for rotating the rotating shaft and that is supported on the connecting pipe, and a switch connected to said motor.

18. The amplification device described in claim 5, further comprising:

a control device that determines whether vibration of the elastic membrane member is to be suppressed, a first switch for controlling the rotation of the motor so that the contact member is displaced in a direction in which the contact member will be in contact with the elastic membrane member when the control device determines that the vibration of the elastic membrane is to be suppressed, and a second switch for controlling the rotation of the motor so that the contact member is displaced in a direction away from the elastic membrane when the control device determines that the vibration of the elastic membrane is not to be suppressed.

19. The amplification device described in claim 18, wherein the control device has a device for detecting the pressure level of air inside the intake duct, and the decision is made on the basis of the value detected by the device that detects the air pressure level.

20. The amplification device described in claim 18, wherein:

the control unit has a device for detecting the engine rotational velocity, and a decision is made on the basis of a value detected by the device for detecting the engine rotational velocity.

21. The amplification device described in claim 18, wherein:

the control unit has a device for detecting the openness of the throttle valve that adjusts the air flow rate fed into the engine inlet port, and a decision is made on the basis of the value detected by the device that detects the openness of the throttle value.

22. An amplification device for amplifying suction noise of a vehicle, comprising:

an intake means for feeding air into an engine inlet port, a pipe means connected to the intake means, an elastic membrane means that blocks a passageway inside of the pipe means, and a contact means that is connected to a pipe means and includes at least one portion that is adapted to selectively contact a surface of the elastic membrane means that faces the intake means.

* * * * *